US010706688B2

(12) United States Patent
Kelly et al.

(10) Patent No.: US 10,706,688 B2
(45) Date of Patent: Jul. 7, 2020

(54) SYSTEM, METHOD AND APPARATUS FOR GAMING IN A CONVENIENT ENVIRONMENT

(71) Applicant: Bally Gaming, Inc., Las Vegas, NV (US)

(72) Inventors: Bryan M. Kelly, Alamo, CA (US); Martin S. Lyons, Henderson, NV (US); John Link, Manteca, CA (US)

(73) Assignee: SG Gaming, Inc., Las Vegas, NV (US)

( * ) Notice: Subject to any disclaimer, the term of this patent is extended or adjusted under 35 U.S.C. 154(b) by 50 days.

(21) Appl. No.: 16/129,395

(22) Filed: Sep. 12, 2018

(65) Prior Publication Data

US 2019/0102997 A1 Apr. 4, 2019

Related U.S. Application Data

(60) Provisional application No. 62/568,006, filed on Oct. 4, 2017.

(51) Int. Cl.
*G07F 17/32* (2006.01)
*G06Q 50/34* (2012.01)

(52) U.S. Cl.
CPC ..... *G07F 17/3272* (2013.01); *G06Q 50/34* (2013.01); *G07F 17/3211* (2013.01); *G07F 17/3223* (2013.01); *G07F 17/3255* (2013.01); *G07F 17/3267* (2013.01)

(58) Field of Classification Search
None
See application file for complete search history.

(56) References Cited

U.S. PATENT DOCUMENTS

| | | | |
|---|---|---|---|
| 5,761,647 | A | 6/1998 | Boushy |
| 6,676,522 | B2 | 1/2004 | Rowe et al. |
| 6,682,421 | B1 | 1/2004 | Rowe et al. |
| 6,800,029 | B2 | 10/2004 | Rowe et al. |
| 6,846,238 | B2 | 1/2005 | Wells |
| 6,971,956 | B2 | 12/2005 | Rowe et al. |
| 7,413,513 | B2 | 8/2008 | Nguyen et al. |
| 7,575,234 | B2 | 8/2009 | Soltys et al. |
| 7,611,409 | B2 | 11/2009 | Muir et al. |
| 7,699,703 | B2 | 4/2010 | Muir et al. |
| 7,850,528 | B2 | 12/2010 | Wells |
| 7,867,092 | B2 | 1/2011 | Paulsen |
| 7,927,211 | B2 | 4/2011 | Rowe et al. |
| 7,950,661 | B2 | 5/2011 | Soltys et al. |
| 7,951,003 | B2 | 5/2011 | Russell et al. |
| 7,967,682 | B2 | 6/2011 | Huizinga |
| 8,057,296 | B2 | 11/2011 | Hedrick et al. |
| 8,137,192 | B2 | 3/2012 | Thomas |
| 8,152,634 | B2 | 4/2012 | Gagner et al. |
| 8,210,942 | B2 | 7/2012 | Shimabukuro et al. |
| 8,226,459 | B2 | 7/2012 | Barrett et al. |

(Continued)

*Primary Examiner* — Tramar Y Harper

(57) ABSTRACT

A system, method and device is set forth for play by multiple players using their mobile devices. Each player tethers their mobile device to a console for remote play whereupon, for each player, a separate account is established for the player. The player may fund their account for value for regulated gaming. The system, method and device are configure to be easily introduce into an existing casino enterprise system such they appear to the system as a gaming device while supporting separate and simultaneous play by the players.

10 Claims, 20 Drawing Sheets

(56) References Cited

U.S. PATENT DOCUMENTS 8,226,474 B2 7/2012 Nguyen et al.
8,241,123 B2 8/2012 Kelly et al.
8,241,127 B2 8/2012 Kovacs
8,267,792 B2 9/2012 Buchholz et al.
8,282,465 B2 10/2012 Giobbi
8,282,490 B2 10/2012 Arezina et al.
8,287,380 B2 10/2012 Nguyen et al.
8,323,099 B2 12/2012 Durham et al.
8,333,655 B2 12/2012 Gagner et al.
8,371,932 B2 2/2013 Gagner et al.
8,382,582 B2 2/2013 Sammon et al.
8,403,750 B2 3/2013 Bone et al.
8,414,373 B2 4/2013 Bone et al.
8,430,745 B2 4/2013 Agarwal et al.
8,447,870 B2 5/2013 Gagner et al.
8,469,260 B2 6/2013 Lyons et al.
8,469,800 B2 6/2013 LeMay et al.
8,506,412 B2 8/2013 Powell et al.
8,529,345 B2 9/2013 Nguyen et al.
8,535,157 B2 9/2013 Kelly et al.
8,550,903 B2 10/2013 Lyons et al.
8,562,424 B2 10/2013 Walker et al.
8,597,111 B2 12/2013 LeMay et al.
8,597,115 B2 12/2013 Sammon et al.
8,608,569 B2 12/2013 Carrico et al.
8,613,668 B2 12/2013 Nelson et al.
8,622,829 B2 1/2014 Nelson
8,622,836 B2 1/2014 Nelson et al.
8,628,418 B2 1/2014 Abbott
8,632,403 B2 1/2014 Nguyen et al.
8,684,843 B2 4/2014 Arezina et al.
8,701,981 B2 4/2014 Lyons et al.
8,721,434 B2 5/2014 Nelson et al.
8,727,881 B2 5/2014 Ansari et al.
8,734,252 B2 5/2014 Nelson
8,784,186 B2 7/2014 Rommerdahl et al.
8,784,211 B2 7/2014 Silva et al.
8,821,274 B2 9/2014 Lyons et al.
8,827,792 B2 9/2014 Sylla et al.
8,827,813 B2 9/2014 Lemay et al.
8,827,814 B2 9/2014 Lemay et al.
8,834,254 B2 9/2014 Buchholz et al.
8,858,323 B2 10/2014 Nguyen et al.
8,858,332 B2 10/2014 Arezina et al.
8,870,647 B2 10/2014 Huizinga
8,876,595 B2 11/2014 Nelson et al.
8,926,422 B2 1/2015 Anderson et al.
8,944,916 B2 2/2015 Abouchar et al.
8,956,222 B2 2/2015 LeMay et al.
8,956,224 B2 2/2015 Gagner et al.
9,011,249 B2 4/2015 Gagner et al.
9,039,523 B2 5/2015 Price et al.
9,058,716 B2 6/2015 Rajaraman et al.
9,070,250 B2 6/2015 Kelly et al.
9,098,975 B2 8/2015 Walker et al.
9,147,313 B2 9/2015 Nelson et al.
9,196,121 B2 11/2015 Walker et al.
9,208,639 B2 12/2015 Gagner et al.
9,214,056 B2 12/2015 Kovacs et al.
9,218,715 B2 12/2015 Price et al.
9,235,953 B2 1/2016 Earley et al.
9,235,964 B2 1/2016 Ward et al.
9,280,867 B2 3/2016 Froy et al.
9,311,769 B2 4/2016 LeMay et al.
9,336,647 B2 5/2016 Nelson et al.
9,339,723 B2 5/2016 Grauzer et al.
9,355,519 B2 5/2016 Lyons et al.
9,361,755 B2 6/2016 Gagner et al.
9,375,644 B2 6/2016 Nelson et al.
9,412,227 B2 8/2016 Nelson et al.
9,412,228 B2 8/2016 Arezina et al.
9,424,713 B2 8/2016 Walker et al.
9,443,382 B2 9/2016 Lyons
9,443,384 B2 9/2016 Price et al.
9,454,870 B2 9/2016 Carpenter et al.
9,472,049 B2 10/2016 Allen et al.
9,483,906 B2 11/2016 LeMay et al.
9,489,794 B2 11/2016 Hilbert et al.
9,520,023 B2 12/2016 Lyons et al.
9,520,030 B2 12/2016 Gagner et al.
9,524,609 B2 12/2016 Shorrock et al.
9,547,954 B2 1/2017 Anderson et al.
9,552,697 B2 1/2017 Earley et al.
9,619,968 B2 4/2017 Gagner et al.
9,640,022 B2 5/2017 Carrico et al.
9,646,452 B2 5/2017 Parra et al.
9,659,437 B2 5/2017 Kelly et al.
9,659,461 B2 5/2017 Grauzer et al.
9,672,688 B2 6/2017 Lyons
9,697,683 B2 7/2017 Lyons et al.
9,734,661 B2 8/2017 Lyons et al.
9,734,667 B2 8/2017 Walker et al.
9,747,750 B2 8/2017 Link et al.
9,754,443 B2 9/2017 Hedrick et al.
9,767,642 B2 9/2017 Hilbert et al.
9,786,123 B2 10/2017 Huizinga
9,792,778 B2 10/2017 Irby, II et al.
9,805,545 B2 10/2017 Keilwert et al.
9,805,547 B2 10/2017 Price et al.
9,805,554 B2 10/2017 Michel et al.
9,824,532 B2 11/2017 Abouchar et al.
9,824,534 B2 11/2017 Nguyen et al.
9,824,536 B2 11/2017 Shorrock et al.
9,842,468 B2 12/2017 Gagner et al.
9,852,578 B2 12/2017 Nelson et al.
9,875,605 B2 1/2018 Irby, II et al.
9,875,607 B2 1/2018 Nelson et al.
9,875,621 B1 1/2018 Michel et al.
9,881,444 B2 1/2018 Nelson et al.
9,892,589 B2 2/2018 Lyons
9,898,889 B2 2/2018 Rajaraman et al.
9,927,244 B2 3/2018 Nelson et al.
9,928,502 B2 3/2018 Curtin et al.
9,928,681 B2 3/2018 LeMay, Jr. et al.
9,940,788 B2 4/2018 Lyons et al.
9,997,015 B2 6/2018 Sylla et al.
10,013,850 B2 7/2018 Nelson et al.
10,068,417 B2 9/2018 Toohey et al.
10,068,418 B2 9/2018 Thomas et al.
2006/0058088 A1* 3/2006 Crawford, III ..... G07F 17/3227 463/13
2006/0178209 A1* 8/2006 Shultz ..... G06Q 10/00 463/28
2006/0189382 A1* 8/2006 Muir ..... G07F 17/32 463/29
2006/0252530 A1 11/2006 Oberberger et al.
2008/0096659 A1* 4/2008 Kreloff ..... G07F 17/3209 463/39
2008/0102916 A1* 5/2008 Kovacs ..... G07F 17/3211 463/16
2008/0146311 A1* 6/2008 Walker ..... 463/20
2008/0182667 A1 7/2008 Davis et al.
2009/0075724 A1* 3/2009 Breeding ..... G07F 17/32 463/25
2009/0124348 A1* 5/2009 Yoseloff ..... G07F 17/32 463/22
2009/0162245 A1 6/2009 Rasmussen
2010/0016056 A1* 1/2010 Thomas ..... G07F 17/32 463/20
2010/0062833 A1 3/2010 Mattice et al.
2010/0069158 A1* 3/2010 Kim ..... A63F 13/12 463/42
2010/0087241 A1 4/2010 Nguyen et al.
2010/0113143 A1 5/2010 Gagner et al.
2010/0113148 A1* 5/2010 Haltovsky ..... G06F 1/1626 463/30
2010/0227680 A1 9/2010 Leopold et al.
2010/0234099 A1* 9/2010 Rasmussen ..... G07F 17/3218 463/29
2011/0034239 A1* 2/2011 Collette ..... G07F 17/32 463/26
2011/0118004 A1 5/2011 Kelly et al.

(56) References Cited

U.S. PATENT DOCUMENTS

2013/0017876 A1* 1/2013 Koumbourlis ..... A63F 13/10 463/11
2013/0065668 A1 3/2013 LeMay et al.
2013/0084963 A1 4/2013 Shorrock et al.
2013/0084972 A1 4/2013 Frady
2013/0084973 A1 4/2013 Frady
2013/0130777 A1* 5/2013 Lemay ..... G07F 17/34 463/25
2013/0130778 A1 5/2013 Anderson et al.
2013/0210517 A1 8/2013 Agarwal et al.
2013/0231192 A1 9/2013 Walker et al.
2013/0252683 A1 9/2013 Rommerdahl et al.
2013/0252713 A1 9/2013 Nelson et al.
2013/0260854 A1 10/2013 White et al.
2013/0316808 A1 11/2013 Nelson et al.
2013/0337878 A1 12/2013 Shepherd et al.
2013/0344941 A1 12/2013 Nelson et al.
2014/0038141 A1 2/2014 Burza et al.
2014/0094276 A1* 4/2014 Ward ..... G07F 17/3272 463/25
2014/0106875 A1 4/2014 Nguyen et al.
2014/0248941 A1 9/2014 Nelson et al.
2014/0278926 A1 9/2014 Close et al.
2014/0278927 A1 9/2014 Close et al.
2016/0063797 A1 3/2016 Shepherd et al.
2016/0071373 A1 3/2016 Anderson et al.
2016/0093166 A1 3/2016 Panambur et al.
2017/0069165 A1 3/2017 Shorrock et al.
2017/0092054 A1 3/2017 Petersen et al.
2017/0092059 A1 3/2017 Nelson
2017/0308878 A1 10/2017 Yang et al.
2017/0352231 A1 12/2017 Nelson
2018/0047249 A1 2/2018 Nelson et al.
2018/0050273 A1* 2/2018 Garoufalis ..... A63F 13/525
2018/0061179 A1 3/2018 Miri et al.
2018/0075697 A1 3/2018 Shorrock et al.

* cited by examiner

PHONE BINDING AND FUNDING UI/FLOW

SYSTEM, METHOD AND APPARATUS FOR GAMING IN A CONVENIENT ENVIRONMENT

CROSS-REFERENCE TO RELATED APPLICATIONS

This application claims priority to U.S. Provisional Application Ser. No. 62/568,006 filed Oct. 4, 2017 and titled "System, Method and Apparatus for Gaming in a Convenient Environment", hereby incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

The present disclosure is directed to system, method and apparatus to providing for remote gaming by one or more players in a lounge, bar, arcade or lounge or similar environment. More particularly it relates to such systems, method and apparatus which provides for a modularized console which does not operatively rely upon utilities provided by a host system for the venue. The system looks to the host, in a casino enterprise environment, like a gaming device but provides for the binding or "tethering" of multiple player mobile devices to a common display console presenting one or more games. The system also supports individual electronic banks or wallets storing data representing credits having actual or virtual value, game credit, win and other meters as well as interactive communication between the console and player mobile devices. Still further the system, method and apparatus provide for players whose mobile devices are tethered to remotely control the one or more games presented from the convenience of a remote location such as a bar, table, chair or sofa.

BACKGROUND

It has been known to provide a multi-player gaming device having a number of fixed gaming terminals linked to a bonus event display. Each player terminal includes a validator to receive physical value in the form of a voucher/ticket or cash to establish credits for the player at their respective terminal. Upon the triggering of a certain game play event the common bonus event display acts to present typically a randomly determined outcome or contest to the eligible players. In such devices the player is tied to their terminal and, since the terminal is fixed, is not free to move about. Further, in such arrangements, the terminals are specially manufactured to be gaming terminals and each is in communication with any casino enterprise backend system for receiving/transmitting data and, for example, reporting for purposes of game performance, accounting and player loyalty tracking.

In a casino environment with perhaps several thousand gaming machines, a network is provided to provide data communication between each gaming machine and a backend system. The backend system may include accounting, maintenance, status, and notification functionality to name just a few. In some cases the network may provide or support game content provided on the gaming machines such as providing a remote resource library to download and/or augment games on the gaming terminal. When a machine is removed from service and replaced with another or a new machine is added to the inventory, that machine is connected to the network through suitable cabling or in some cases a WiFi connection to provide the aforesaid communication. Standard communication protocols have been adopted by the industry to support communications between the system and the machines on the casino floor. Connecting a new gaming machine to the network typically does not require reconfiguration of the casino venue host network topology.

In a casino environment it has been known to provide one or more servers for operating a player loyalty program. This loyalty program is operated on the casino venue network supporting topology and requires network connectivity with the gaming machines and other supporting terminals on the casino floor such as player access kiosks, table game pit terminals and point of sale terminals. For example, Boushy, U.S. Pat. No. 5,761,647 titled "National Customer Recognition System and Method" and Link et al, U.S. Pat. No. 9,747,750 titled "System and Method for Providing Loyalty-Based Virtual Objects Across Various Media Including Gaming Devices", the disclosures of which are incorporated by reference, describe features of a player loyalty program system and method. Players register into the loyalty program, are assigned an account and issued, for example, a player card having a machine readable magnetic stripe. At a card reader at a gaming machine or table game, the card is read and gaming activity such as wagers and wins is reported to the servers which derive loyalty "points" allocated into the player's account. These points can be redeemed for goods and services as well as redeemed for wagering. In Kelly et al, U.S. Pat. No. 8,241,123 titled "Video Switcher and Touch Router Method for a Gaming Machine", the disclosure of which is incorporated by reference, there is disclosed a player-system interface for displaying, for example, system derived content, on a gaming terminal video display as opposed to a dedicated, separate tracking module video display.

The player interface also provides a vehicle to provide system generating bonusing to players. In Kelly et al, US 2011/0118004 titled "Player Gaming Console, Gaming Machine, Networked Gaming System and Method", the disclosure of which is incorporated by reference there is disclosed a system providing system delivered bonuses to players through the player-system interface.

In Kovacs U.S. Pat. No. 9,214,056 titled "Gaming System and Method Which Enables Multiple Players to Simultaneously Play Multiple Individual Games or Group Games on a Central Display" there is disclosed a system including a community video display to display a number of games and separate player stations which can be terminals or mobile devices. From the player stations the player can play one or more of the displayed games. As disclosed the venue for the system may include seating such as sofas and chairs. The disclosed arrangement requires a supporting network topology to support data routing and switching such as middleware servers disposed between the player stations and the game server. There is no disclosure of providing such a system that can be "dropped" into a casino venue without setting up the required topology and connecting to the host casino wired and wireless network and services. Stated differently the system can cannot be installed into a gaming venue and appear to the network as just another gaming machine.

In Lyons, U.S. Pat. No. 9,672,688 titled 'System and Method for Cross platform Persistent Gaming Sessions Using a Mobile Device", the disclosure of which is incorporated by reference, there is disclosed a system and method for a player to migrate game play from a gaming terminal to stream to their mobile device for play remote from the terminal. When play is migrated the physical terminal is rendered inactive for play by other players.

A drawback to these prior approaches is that a system to support localized gaming using mobile or remote player terminals requires a network topology to support the system as well as network with the host venue network and to support the provision of multiple games, Ecommercial transactions and player tracking. There is a need to provide a system, apparatus and method which enables easy installation into an existing casino environment without additional configuration of the host network or extensive network connectivity. Basically a "suitcase gaming console" type of arrangement is desirable whereby the gaming console can be "dropped into" a venue and still provide the desired functionality but, from a functional standpoint, appears to the host system as just another added gaming machine. In such an arrangement there should be a convenient method or apparatus to enable a player to use their own mobile device such as a cellular telephone or tablet device and to securely and functionally bind or tether their device to a common game console having a community video display for displaying one or more gaming opportunities and outcomes. The console should further provide a convenient technique for the player to apply value for establishing credits for wagering using their mobile device, for arranging, maintaining and displaying, for each player, individual credit meters and win meters at the console provided community display as well as at the player's personal device. That is, in the prior art, a common approach has been to provide configured fixed terminals each displaying and maintaining such meters. Where multiple players use their own devices tethered to a single gaming device a problem is presented of metering and accounting for the play of the players for a common game or for different games presented at the console display. That is, since the suitcase console looks like a gaming machine to the system there is a need to account for individual play such as player tracking of wagers/wins for the purposes of accumulating or debiting player loyalty assets. Where a mobile device is configured by a downloaded application considerations of configurations for different operating systems as well as data and communication security must be taken into account. As mentioned above the suitcase console should also support player tracking to the host network.

SUMMARY

Briefly, and in general terms, various embodiments are directed to systems and methods that provide for the incorporation of a multiplayer suitcase console into a gaming system environment which, even though it accommodates wireless, wagered play by multiple players, appears to the system from a connectivity standpoint as a single gaming machine. The systems and methods of the console are arranged to enable players to use their personal mobile devices to participate in one or more games displayed at a common console platform community display. In an embodiment players functionally tether or bind their devices to the console using various techniques whereupon a unique player, temporary, local account is established/accessed for the player which can be funded for play of the one or more games and which is configured to provide separate credit, win and bet meters as well as a transactions trail for each player. The player accounts are established/accessed at the console and accordingly new network functionality is not required to support such accounts. However, in an embodiment, the casino network may augment the account function by, for example, enabling a player to transfer funds from an existing casino network account to the local, console supported, temporary account.

In an embodiment the console has a large, community video display for simultaneous participation by existing tethered and newly tethered players in provided games and events and is configured to display the game and at least the awards associated with each player as displayed at the common video display. Where a displayed event is, for example, a sports contest supporting wagering, i.e. sports wagering, the same may also be provided and accessed at the console For one or more embodiments there is set forth a system and method for supporting localized remote gaming by one or more players each using a mobile player device having a video interface and the method including a game console having a large console community display to display game events for a plurality of players and one or more console processors for one or more of (a) controlling the console display to display gaming event content including outcomes for each event or (b) accessing and receiving from a remote source event content for display of event outcomes at the console display for each event. The console system includes a wireless communication network to provide for local wireless communication between the one or more console processors and the player mobile devices. A tethering unit associated with the console has a unit display, the tethering unit controlled by the one or more console processors to display a graphical user interface for players to functionally tether their devices to the console system by one or more of (a) scanning or entering a code or (b) entering the mobile device cellular number or (c) other techniques to uniquely identify the mobile device for establishing a wireless communication link between the console system and the player mobile devices.

The one or more console processors are configured to, upon each player tethering their device, establish at the console a unique, local, temporary, player account associated with each tethered player device including credit, wager and win meter data as well as data representing transaction receipts between the player, the system and their account. Means are provided for each player of a tethered device to apply credits to their account for wagering.

The one or more processors are configured for wireless instructions from a player device to register a wager on a selected game event, the one or more processors configured to control the console display and video interface to display the play and outcome for one or more game events and for each player update the credit meter, win meter and wager meters. To support reporting from the console to the casino network (WAN) the game events for each player is saved, processed and reported by, for example, transmitting to the casino network strings, stacks or tables of data such that, to the casino network, the console appears to be a single gaming device but the data for each player and game is separately accounted for such that the data is reported for multiple players and games but to the network appears like data from a single gaming device.

In an embodiment means may be provided for a player to credit value to their established local account by providing a unique code associated with their account at a station for receiving one or more of currency, vouchers or credit transfers associated with an accessible electronic account. Like a gaming device the console will report to the network data reflective of "cash-in" and "cash-out" transactions; however where there are multiple players there may be periodic bulk reporting for the multiple players processed at the back end network for allocation to any player network account such as a player loyalty account.

In an embodiment the one or more processors are configured to control the console display to display at least a portion of the players' accounts such as the win meter data. The display may be in display windows and the display windows may be arranged according to the order in which the players tethered their devices to the console, e.g. from left to right. At tethering the players may be requested to name their accounts. The display windows at the community display may display the selected players' names associated with their game/meter/win display.

In an embodiment the one or more processors also communicate over the console supported local network (LAN) to provide for display on each tethered mobile device at least a portion of the meter data. The console system may support providing for display at the players' mobile devices graphical replications of the game play in addition to the display at the community display.

In an embodiment the one or more processors supported by the console may provide to the player's mobile device prior to the time of tethering configuration data, e.g. an application, to configure the player's device to display and arrange the display of meter data, game play as well as a player user interface for registering wagers and controlling play.

Also provided are means by which players may close their account and receive whatever value, if any, is in their account by way of one or more of electronic transfer of funds or providing a redeemable physical instrument such as a voucher, ticket or card.

In an embodiment the player device application may provide a system display to provide the player with system delivered bonus features or games as well as data related to a player loyalty account such as comp points earned, available events and promotions or benefits and, where provided, marketing based funds which can be used for wagering.

In an embodiment the console system may shape the community display according to the number and types of games requested to be played by players.

DESCRIPTION

Figure 1A:
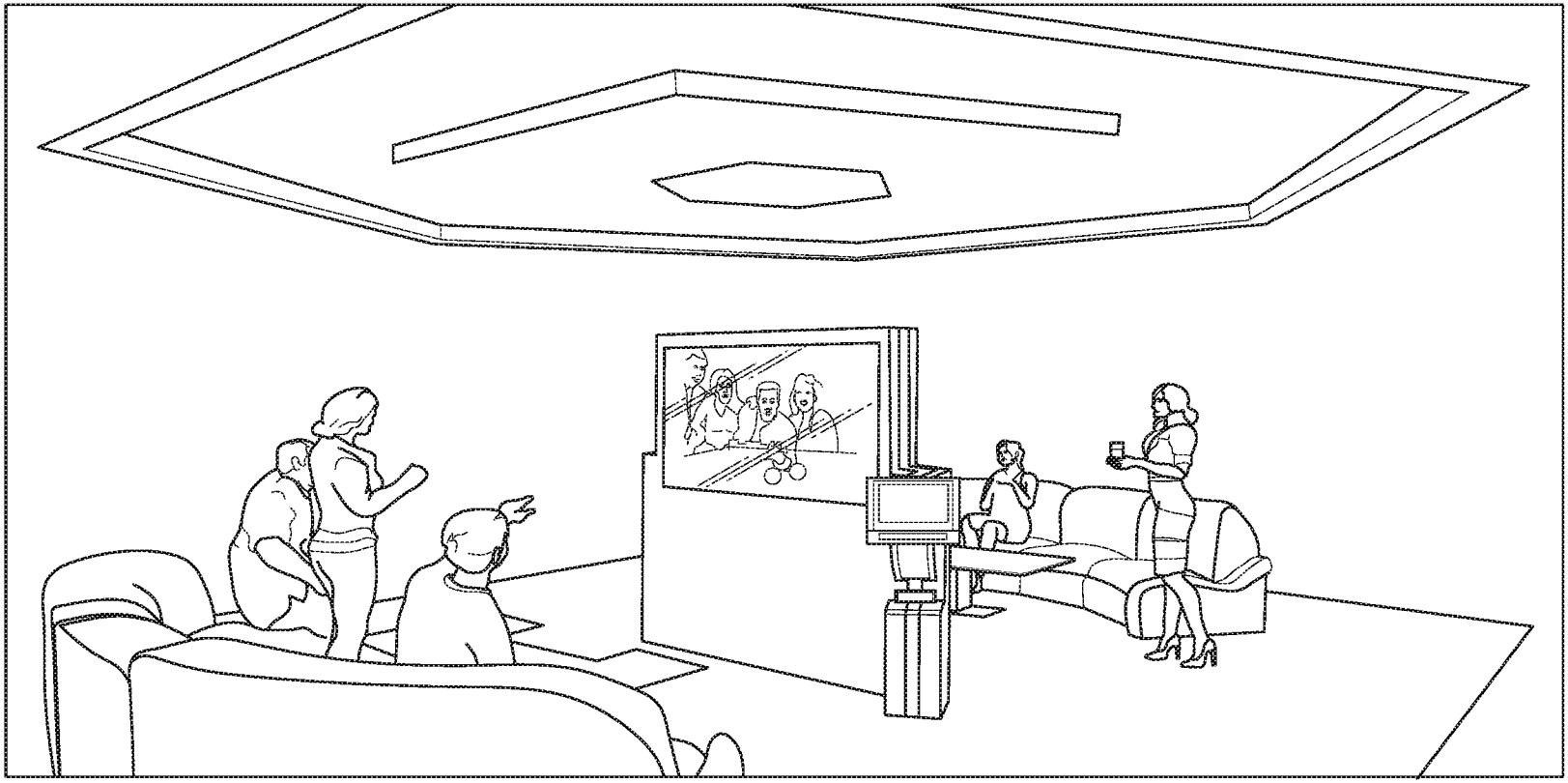
FIG. 1A is a view of an environment including the gaming console which may host the systems and methods of the present invention.
Figure 1B:
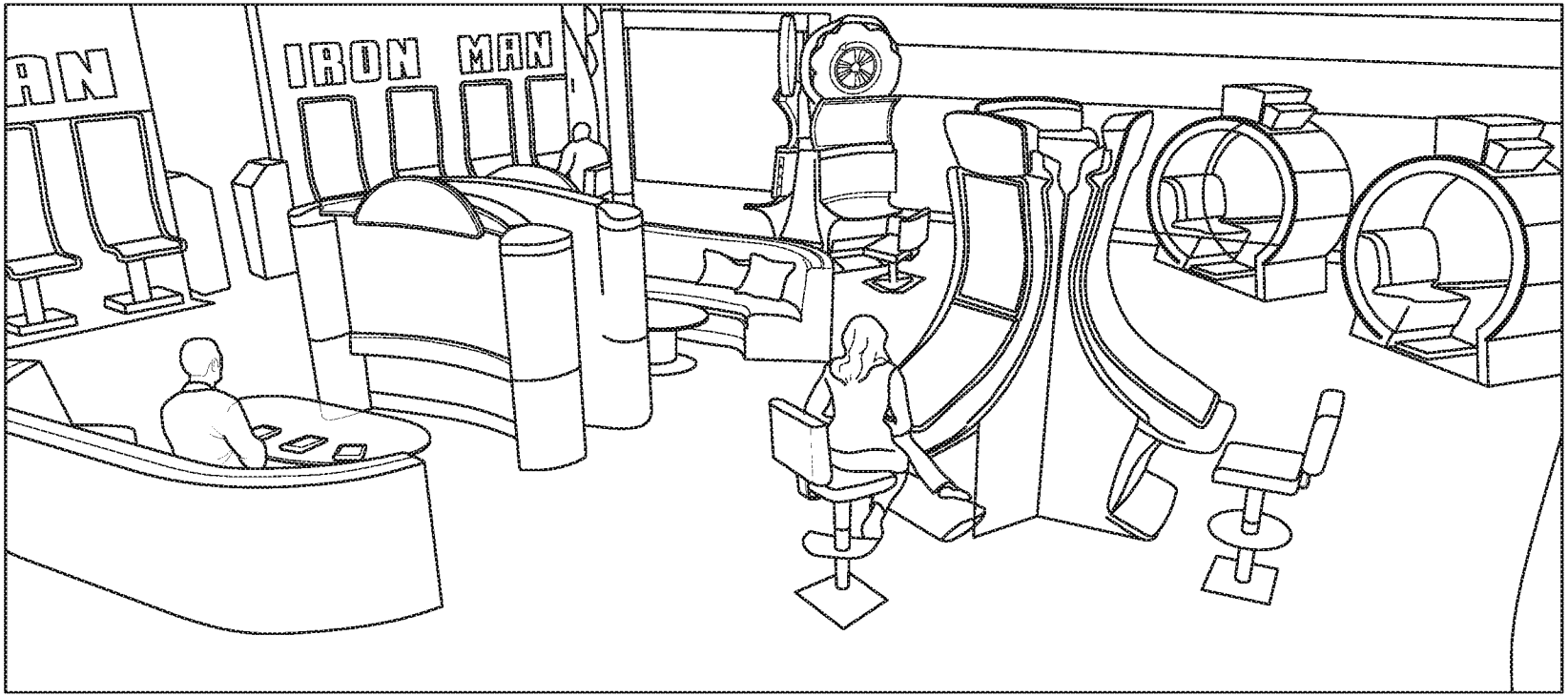
FIG. 1B is a view of an embodiment of the gaming console installed in a casino gaming environment in proximity stand-alone gaming machines.
Figure 2:
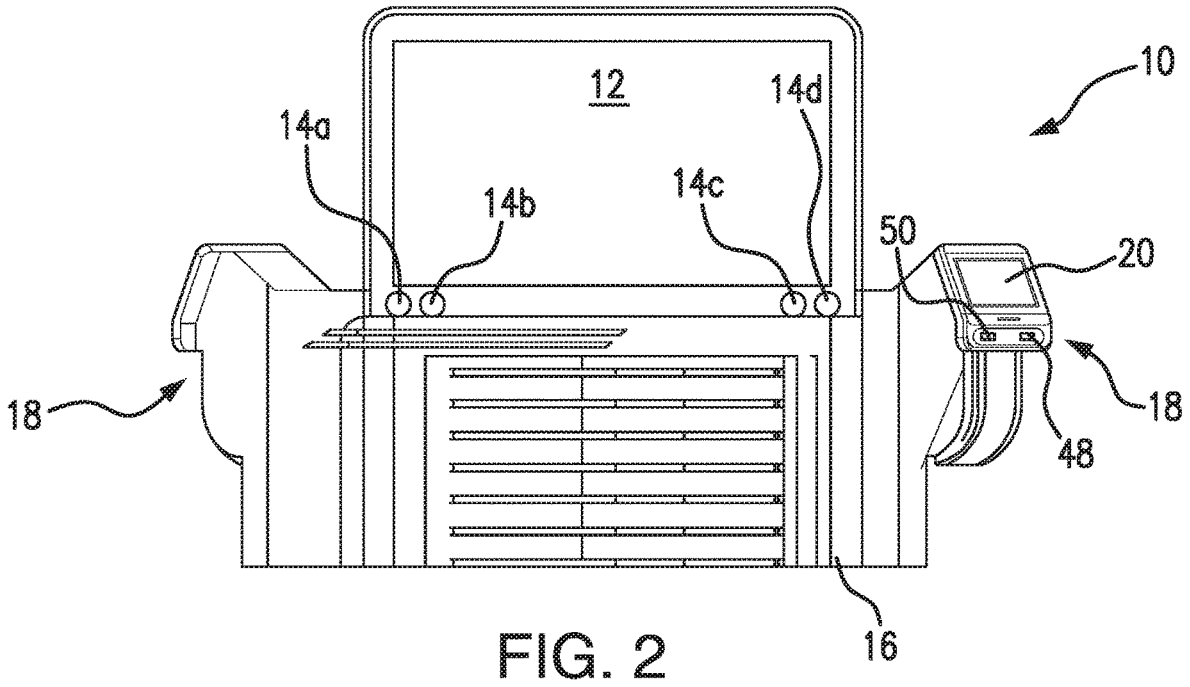
FIG. 2 is a front view of an embodiment of the gaming console.
Figure 3:
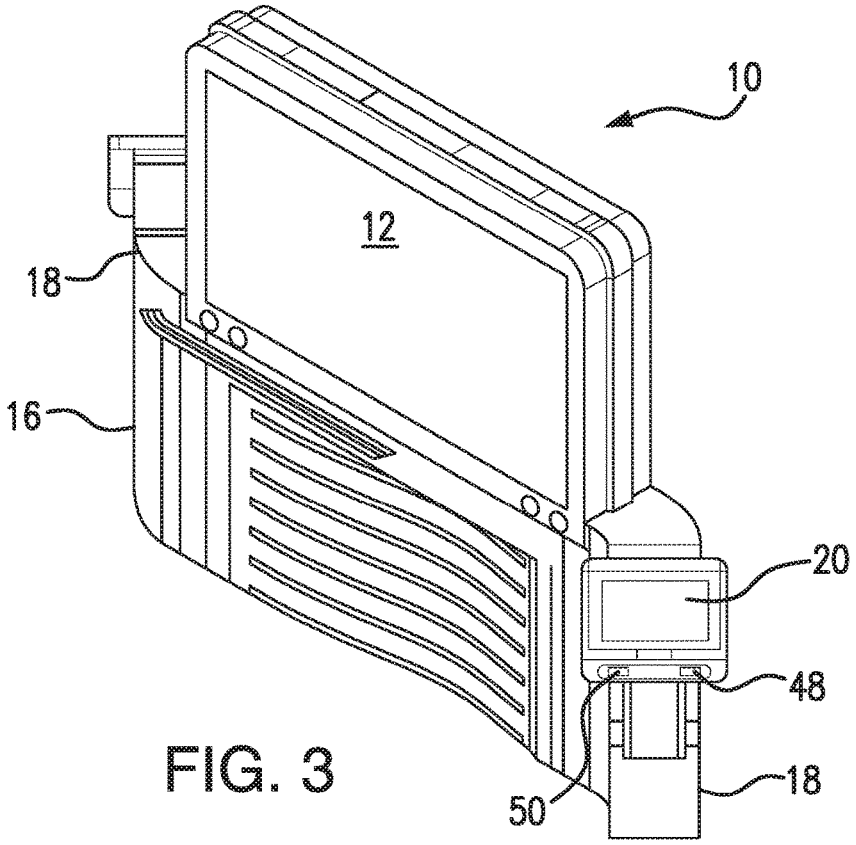
FIG. 3 is a front-top-side perspective view of the gaming console.
Figure 4:
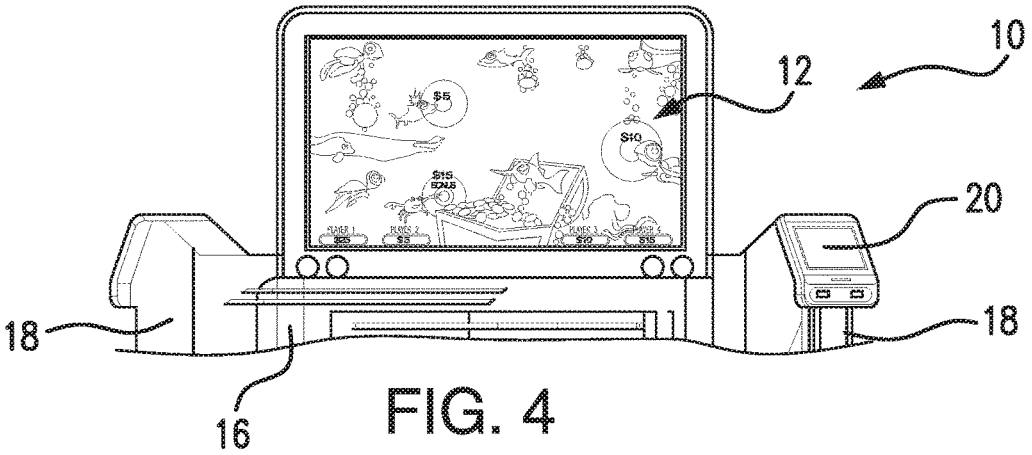
FIG. 4 is an enlarged front view of the gaming console illustrating an example of game content for the large video display.

Turning to the drawings FIG. 1 illustrates an environment of a lounge, bar, or other venue at a casino enterprise to accommodate one or more embodiments of the system and method according to the present invention. To provide an entertaining game platform for player in the environment a console 10 is provided as shown in FIGS. 1-3. It is a feature of the console 10 according to the various embodiments of the present invention to be incorporated into an casino enterprise environment with little or no changes to or additional requirements for the enterprise network system, i.e. to make deployment of the console with its additional functionalities the same as installing a new slot machine onto a gaming floor. The gaming floor as referred to herein includes any regulated gaming space in a casino enterprise which can be an open casino space or a lounge or bar where gaming takes place. Further, while the description herein is directed to deployment into a regulated gaming casino enterprise the console 10 could also be deployed into non-regulated spaces such as arcades, bars and clubs.

The console 10 includes one or more upstanding console video displays 12 arranged for viewing by nearby players and bystanders. In an embodiment two console video displays 12 may be arranged in a back-to-back configuration to accommodate players on either side of the console 10. In another embodiment only one console video display 12 is provided such as, for example, where the console 10 is deployed against a wall. Other embodiments may include more console video displays 12 or video displays 12 having a curved configuration arranged in either a portrait of landscape mode.

To provide audio content an audio system which may include speakers 14*a-d* as well as surround sound speakers (not shown) arranged in the environment. A console stanchion 16 supporting the console video displays 12 may have a fanciful and attractive lighted design to attract players as well as additional speakers and auxiliary video displays (not shown).

To enable the players to functionally tether mobile devices for play of games presented on the console 10, the console 10 includes one or more tethering units 18. Each tethering unit 18 has a tethering unit video display 20 to provide a graphical user interface for players to tether their mobile devices for play and provide other information to and receive input from players. Preferably the video displays 20 are touch input enabled—however the tethering units may include physical buttons as well. In an embodiment the tethering units 18 may include a card reader 48 for reading a player loyalty card inserted by a player for accessing the player's loyalty account as described in Kelly et al, US 2011/0118004 titled "Player Gaming Console, Gaming Machine, Networked Gaming System and Method", the disclosure of which is incorporated by reference. This card reader 48 may also read a bank, casino or other institutionally issued magnetic or smart card to access and transfer funds for gaming. Still further, one or more tethering units 18 may include a currency and/or ticket/script validator 50 again to enable a player to deposit funds for gaming as hereinafter described. These utilities of loyalty card reader 48 and/or ticket/script validator 50 may also be located at a separate kiosk linked through a network to one or more of the console 10 and the player's mobile device 22*a-d* (FIG. 5).

Figure 5:
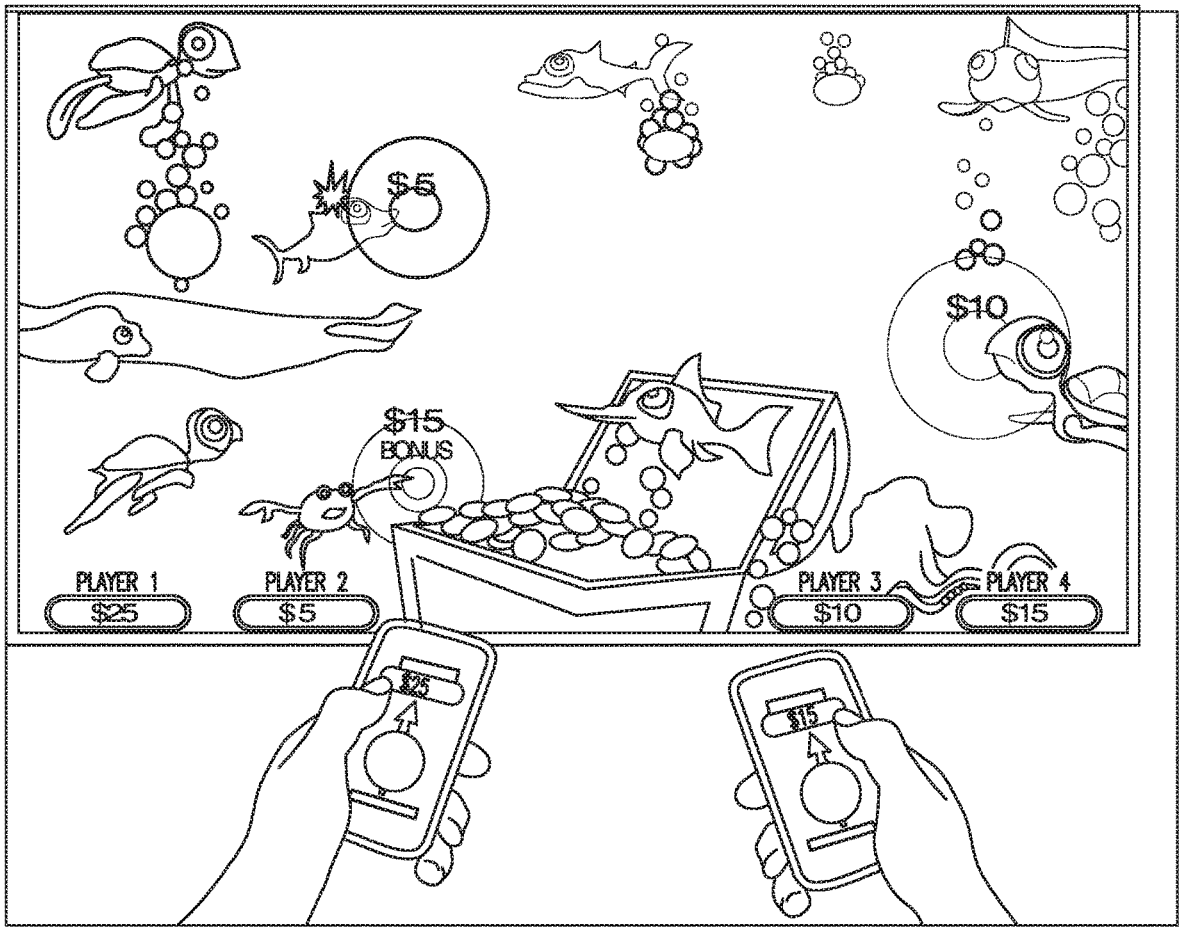
FIG. 5 is an enlarged view of the example of game content of FIG. 4 and illustrating players interacting with the console using wireless, mobile devices.

The system and method of the present invention are directed to features to provide for players, using their own mobile devices 22*a-d* as suggested in FIG. 5, to interact with the console 10 for the play of one or more games or events. In an embodiment the game/event may be a competitive or collaborative game among the players, single game instances played by one or more players or other events such as sports wagering or other events. A typical user device 22*a-d* is a mobile smart device such as a telephone or tablet including utilities such as a device video display 24 (e.g. FIG. 10F) having a touch screen supporting generated graphical user interfaces (GUIs), a broadband, WiFi and NFC transceiver, GPS capability, gyroscope, a processor and memory as is typical in most available smart devices 22*a-d*. As will be described herein the system and method of the present invention advantageously leverages these utilities to prove a unique player experience.

Figure 6:
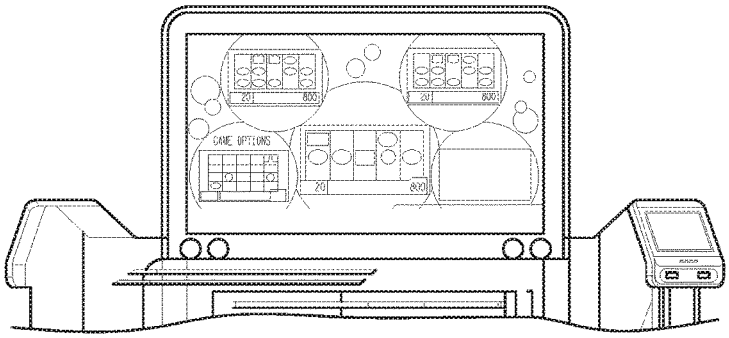
FIG. 6 illustrates the game console displaying content for several games to play.

The system and method of the various embodiment of the present invention enable a single player to play a game or event presented on the console video display 12 using their mobile device 22*a-d* from a chair or seat spaced from the console 10. The game(s) may be solo games where the player wagers toward receiving either a winning or losing outcome such as a typical slot machine game, a competitive video game where players wager and compete toward a winning outcome in hopes of winning a pot or intermediate rewards, sports wagering, or a collaborative game where players play toward a common winning outcome or play as individuals in a commonly presented event. Examples of a collaborative game may be a fishing or shooting game where players post a wager and play the common presentation of the event such as a lake where the players, using their mobile devices, cast lures or coins trying to catch the largest or the most virtual fish which, when caught or eat a virtual coin, register an award. In some embodiments solo play may be supported by simultaneously providing multiple games at the console video display 12 as suggested by FIG. 6 where a player can select a game for solo play. In a related embodiment, even where there are "X" games offered for solo play more than X players can participate by "back-betting" with the player primarily associated with game play. That is, Player A may play a game of "Queens Fortune" presented at the console 10 and Players B-F may wager on but be tied to and rely on the play of player A.

Setting aside for the time being the feature of providing a system which can be dropped into a casino enterprise floor, it should be understood that challenges are presented where multiple players are wagering, entering or ending play at various times and are controlling their individual actions with the mobile devices 22*a-d*. These challenges include providing a mechanism for tethering player mobile devices 22*a-d* for play where the mobile devices 22*a-d* may have different operating systems, e.g. Apple and Android. They also include providing and distinguishing individual control by a player's mobile device 22*a-d*. There is a further challenge of providing for the players to acquire wagering credits, add credits, cash out credits as well as meter wins, loses and credit balance and display some or all those events where multiple players are simultaneously playing at a common console 10. Regulations and consistency with good practices and to avoid disputes, require accounting for each player's transactions separately, e.g. money deposited for play, wagers, winnings, player loyalty points/credits/awards, cash out events and taxable winnings which must be reported to taxing authorities. In addition to tracking the transactions from a player standpoint, casino accounting practices also require tracking transactions for auditing and business intelligence purposes.

Regarding play, casino players have come to expect that their play be accounted for by the casino loyalty program and that system generated bonus events, if provided on the casino floor by the casino, will likewise be provided for play of the console 10. Thus another challenge is presented to provide such features to players using their mobile devices for simultaneous play of games and events at the console 10.

Figure 7:
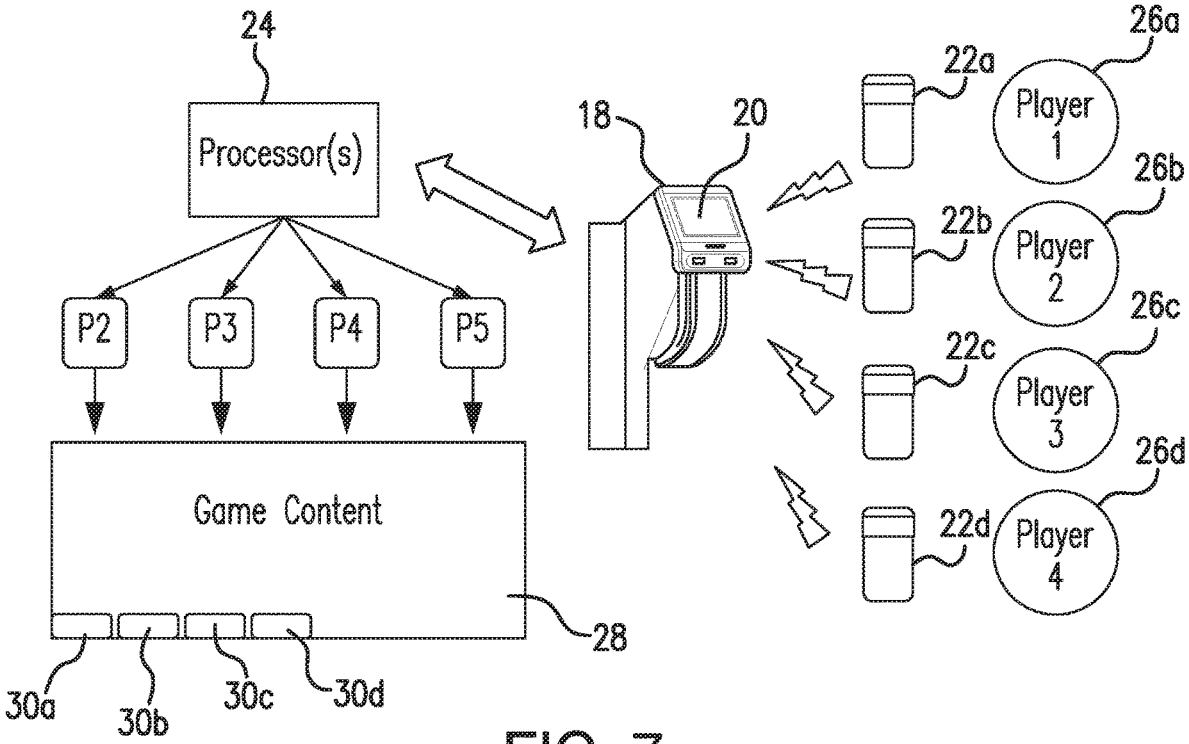
FIG. 7 is a diagram illustrating the tethering by players of their mobile devices through a console tethering unit and the establishment of player accounts.
Figure 10A:
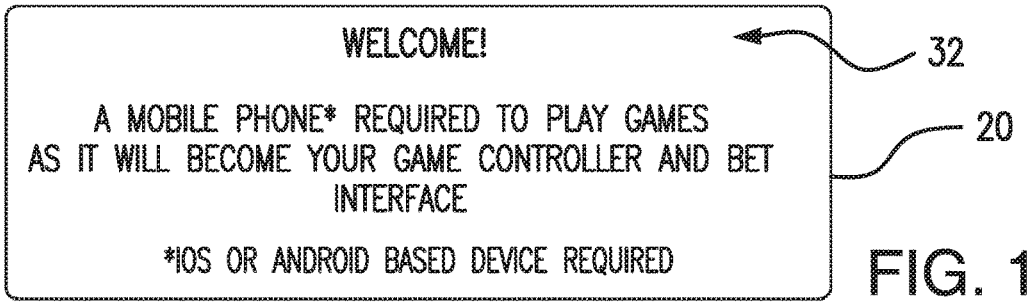
FIGS. 10A through 10I illustrate examples of the user interface display of the tethering unit and the player's device to tether the player's device to the console for mobile, remote play.
Figure 10B:
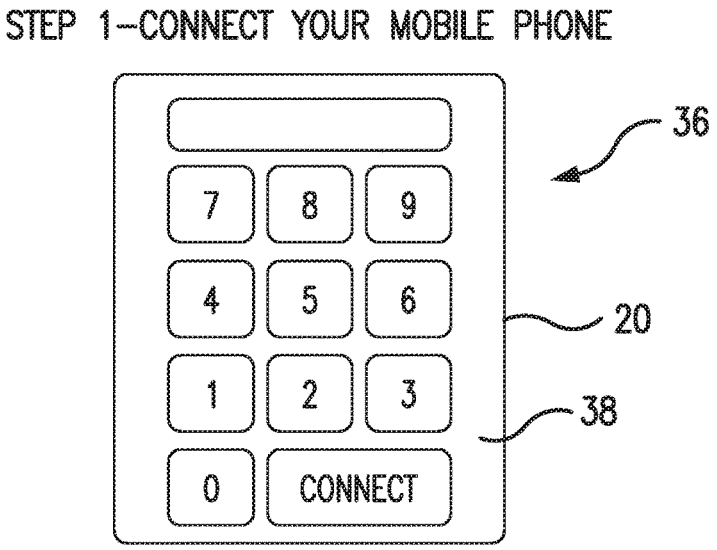
Figure 10C:
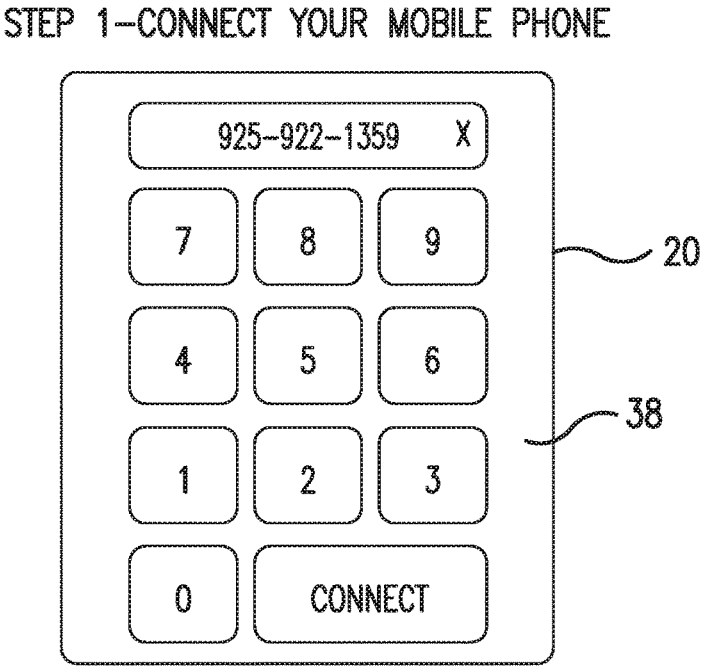
Figure 10D:
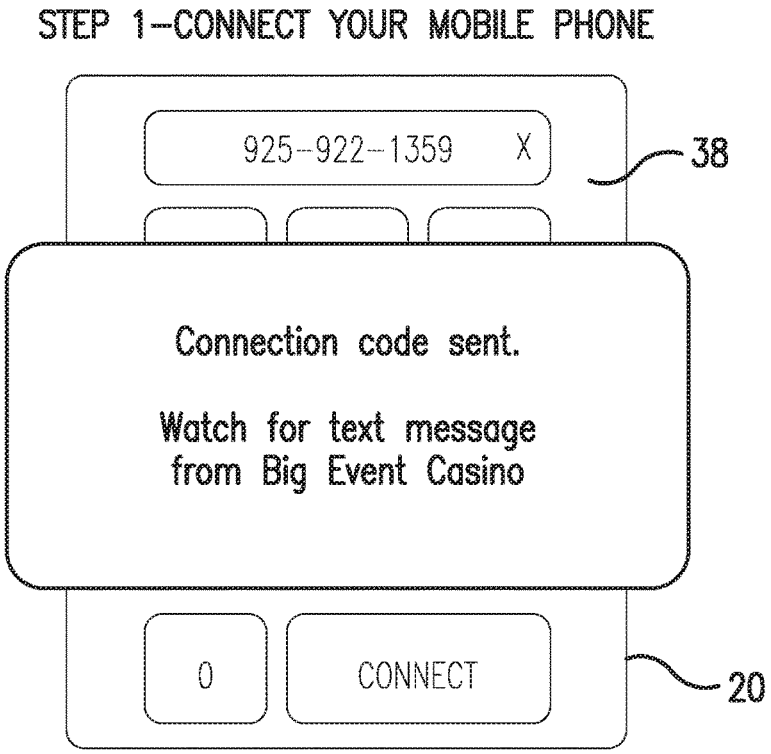
Figure 10E:
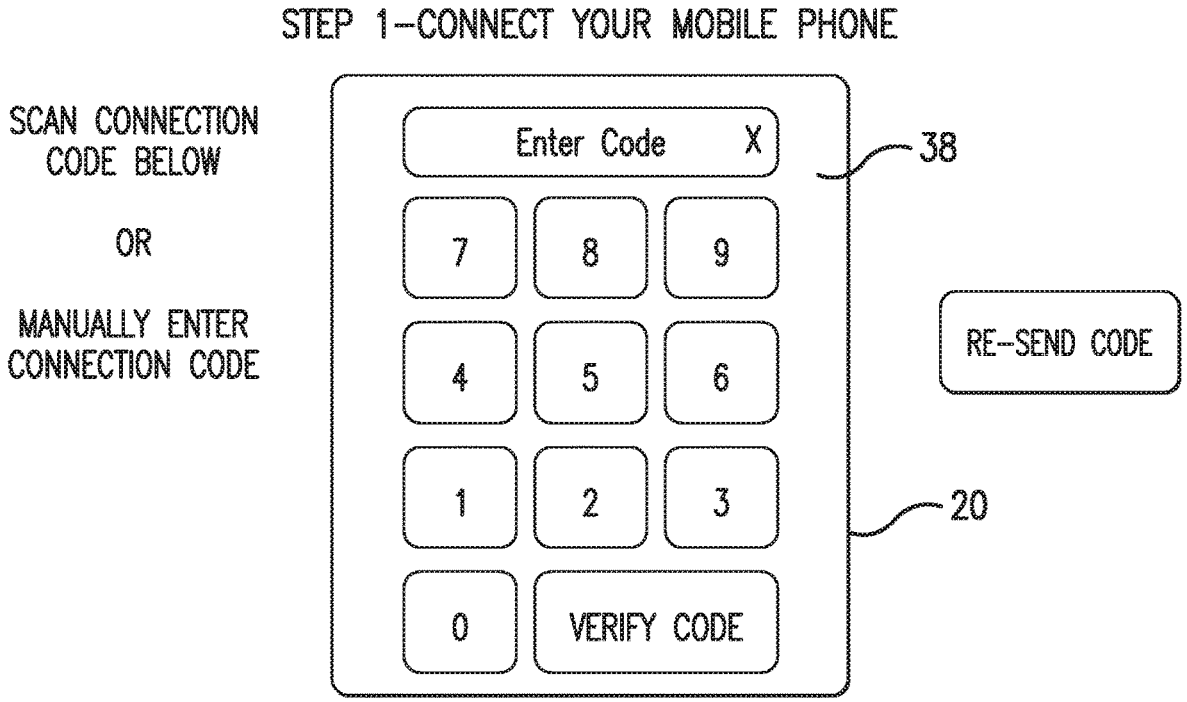
Figure 10F:
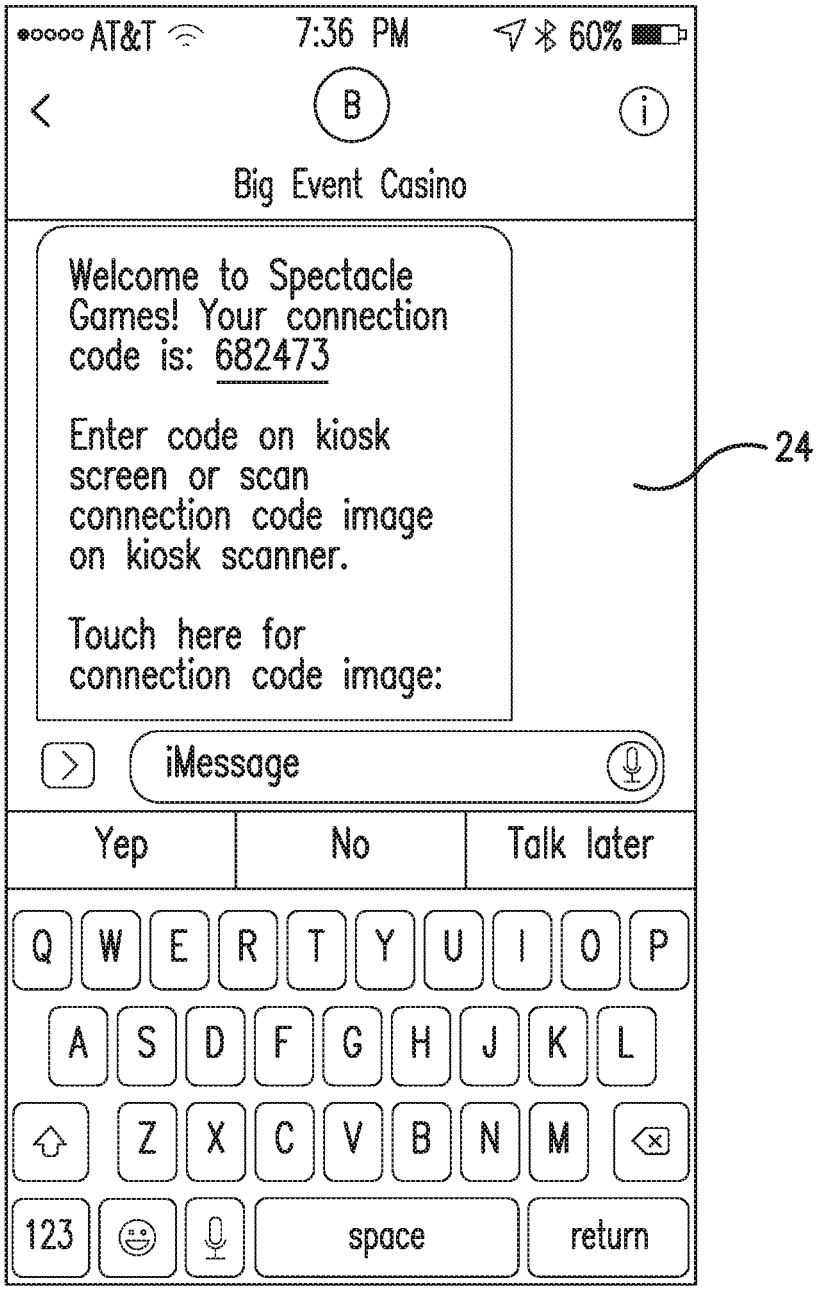
Figure 10G:
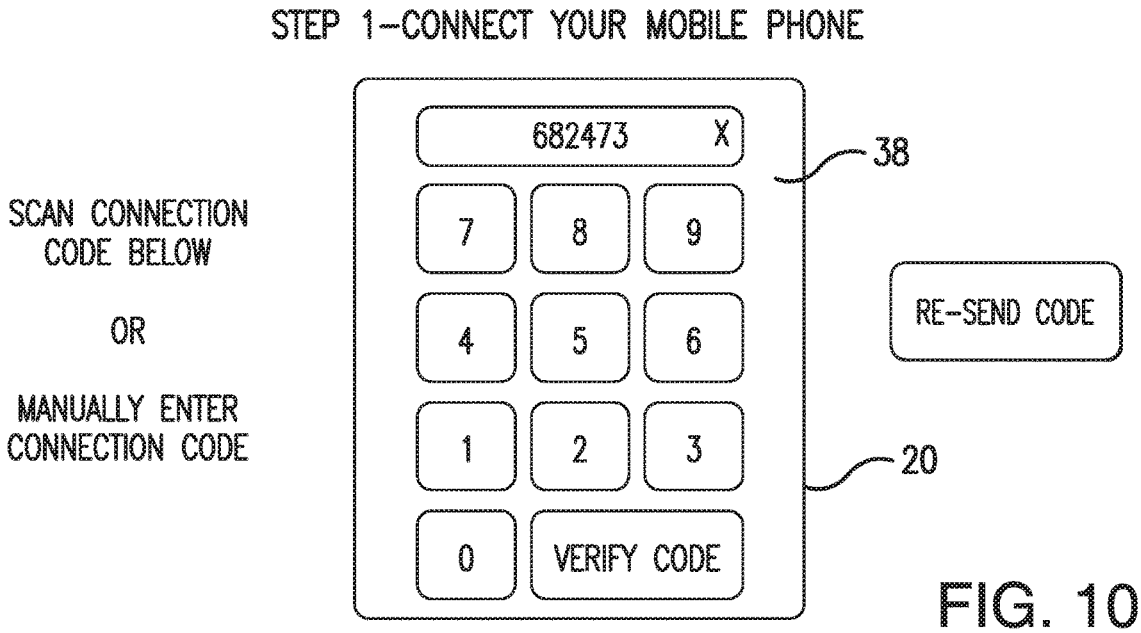
Figure 10H:
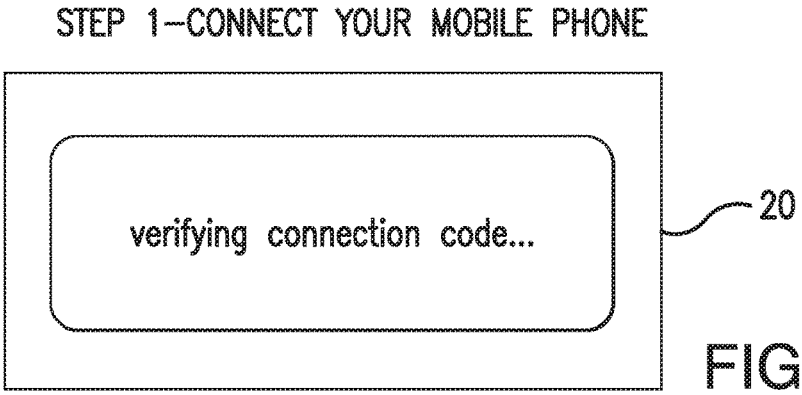
Figure 10I:
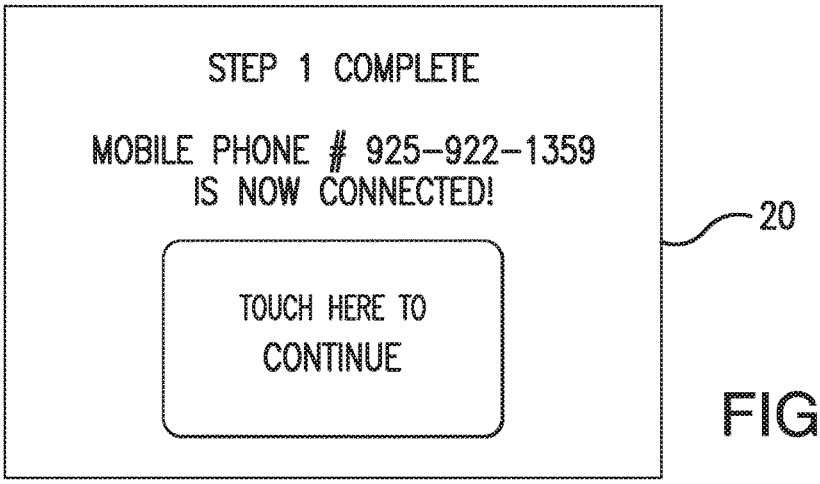

FIGS. 7 and 10I illustrate how players tether their personal mobile devices 22*a-d* to the console 10 for play. An advantage to tethering is that most players already have mobile devices 22*a-d* with them and therefore the system does not require the expense of providing specially configured terminals. In the environment of the console 10, several players may already be engaged in play. A new player sees the activity and decides to join in. To do so and provide a degree of individual input the player is required to tether their mobile device 22*d* for play at the console 10. FIG. 7 provides a high level illustration of the console 10 architecture to support tethering. One or more console processors 24 are provided which may be housed within, for example, the stanchion 16 or even remotely. The processor 24, which may in fact embrace multiple processors, operates the console 10, counsel video display 12 and tethering units 18 and their tethering unit video displays 20. The player mobile devices are shown as mobile devices 22*a-d* for illustrative purposes for players 26*a-d*, respectively. The console video display 12 is configured to display game or event content 28 as well as individual player meters 30*a-d* each allocated and unique for the respective players 26*a-d*. These meters 30*a-d* may be statically displayed anywhere on the console video display 12, may be displayed to move about the console video display 12 so as to, for example, follow events for individual players and may display one or more of wins, wagers, credits available and include a name or tag to distinguish one meter

30*a-d* from another. The rendition of the meters 30*a-d* within the console video display 12 may be arranged based upon the order in which the players 26*a-d* tethered there devices 22*a-d* for play of the console 10.

Figure 9:
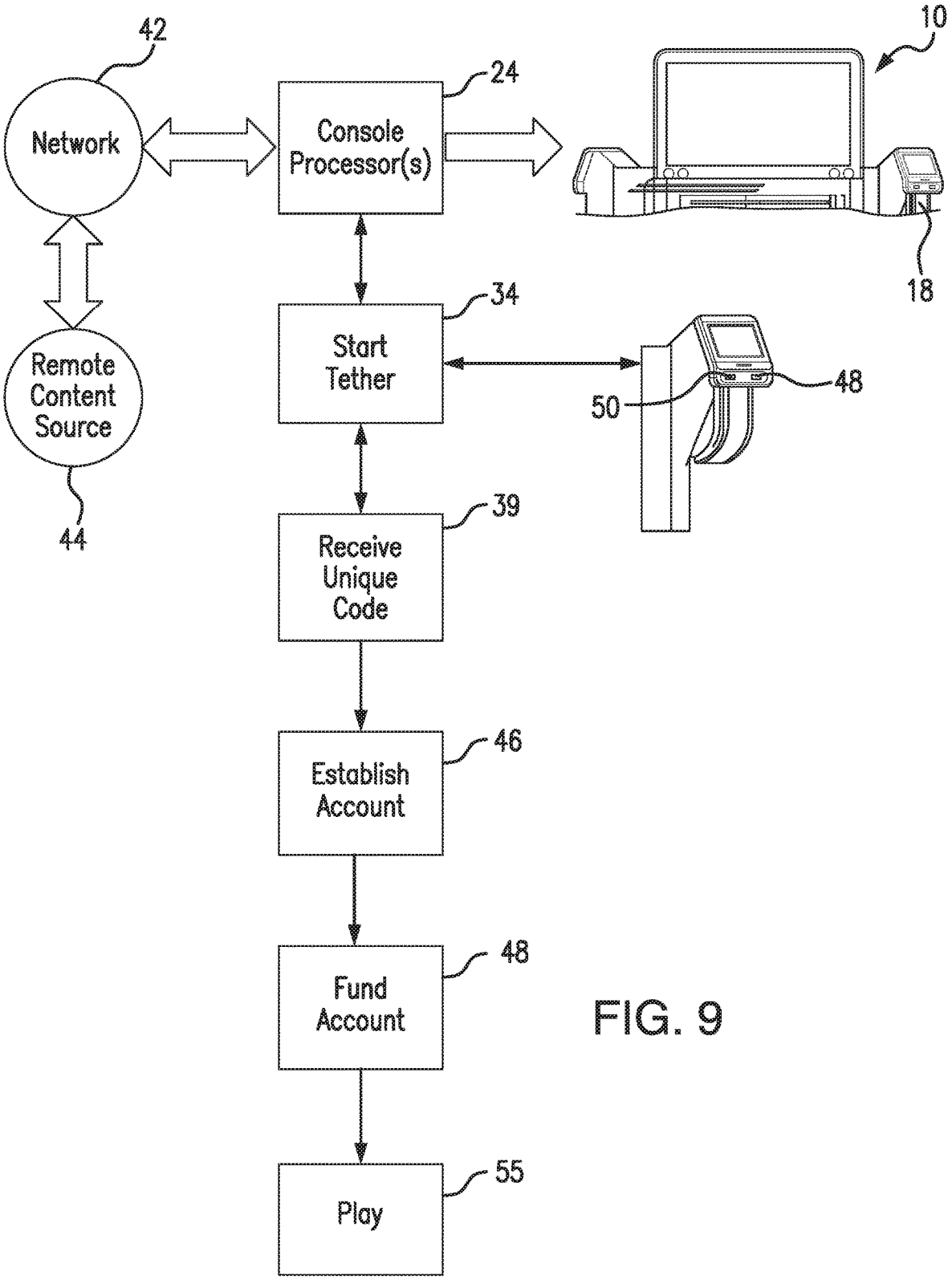
FIG. 9 is a process diagram showing the delivery of content, the tethering of player devices and the funding of the player's account for play.

Returning to the description of the player, say player 26*d*, wishing to join in game play, the player 26*d* approaches and awakes the tethering unit video display 20 which at FIG. 10A displays a welcome screen 32 to start the tether at 34 (FIG. 9). The processor 24 controls the tethering unit display 20 to display a graphical user interface (GUI) connect screen 36 as suggested in FIG. 10B requesting player 26*d* enter their mobile telephone number via a presented touch screen keypad 38. Player 26*d* enters their mobile telephone number as shown in FIG. 10C which is received at 39 by the processor 24 through a console communication network. As described below the processor 24 validates the mobile number. If valid the processor 24 causes, through the mobile telephone communication network (broadband and/or WiFi) a unique connection code, alpha-numeric, numerical or a machine readable image to be transmitted to the player 26*d* mobile device 22*d*. The tethering unit video display 20 displays, as suggested in FIG. 10D, a message confirming that the code has been sent to the player's mobile device 22*d*. FIG. 10F shows an example of a display at the player's mobile device 22*d* of a message including the code. In the embodiment of FIG. 10F the message includes both a numeric code as well as a link to access a code image suitable for scanning. At the tethering unit video display 20 the player 26*d* is invited by the display of a user interface (FIG. 10E) to enter their code through a touch screen keypad 38. Where the code is alpha-numeric or numeric the player may type in their code. Where the code is a machine readable QR code, bar code or glyph, the player would be invited to position the display of the code from their mobile device 22*d* video display in a position at the tethering unit 18 for reading of the code. FIG. 10G illustrates an embodiment where player 26*d* has entered the code using the GUI keypad 38. FIGS. 10H-I illustrate an example of the tethering unit video display 20 screen showing that connection, i.e. tethering, is in progress and a message showing that tethering is complete and the player 26*d* mobile device 22*d* is now connected to the system supporting play of games and events on the console 10.

FIG. 9 shows a high level arrangement for tethering and establishing a player account for play. As described above the processor 24 can control the console video display 12 to display the desired content. This content may natively reside in memory structures at the console 10 such as storing game software and graphics in digital memory accessed by one or several of the processors 24 to display and operate the game or event. In an embodiment the processor 24 is in communication with one or more communication networks (local area network (LAN), wide area network (WAN), WiFi, Internet, Broadband, NFC). The WiFi and/or Broadband at least facilitate tethering inasmuch as messaging to the player's device 22*d* is done during that process. NFC may also be used to support tethering such as, for example, prompting a NFC signal communication between the player device and the tethering unit 18 to support tethering. WiFi also supports interaction between the console 10 and the player device 22*d* for play of the game or event such as transmitting player input via the mobile device 22*d* video display GUI and gesture data (supported by the mobile device gyroscope) such as to point to a display object to use a gesture to spin a reel. As shown in FIG. 9A the network 42 may also access a remote content source 44 such as a games database, a sports or other broadcast (for example, sports wagering), pre-recorded events or other content source to support play at the console 10. At shown this content is provided to the console video display 12.

Continuing with FIG. 9 to support wagering the system and method provide that, upon tethering, at 46 the establishment by the processor 24 of a unique, and perhaps temporary, for this gaming session, player account. The account may be "named" by the tethering code, mobile device telephone number or other unique nomenclature. In an embodiment, at tethering (or before or after) a player may also have their player loyalty card read at a reader disposed at, for example, the tethering unit 18. In the example above player 26*d* after he/she has tethered their mobile device 26*d* for play at the console 10, he/she has their player loyalty club card read at a card reader 48 (FIG. 9) at the tethering unit 18. In this instance, the play of the player 26*d* is tracked for purposes of allocating "comp" points (a virtual currency which may be redeemed for cash, free play or goods or services as is known in the art) as well as providing system defined bonuses to carded players. The tethered account and the established loyalty account may be linked at either the processor 24 or a system server.

In order to play wagering for value games at the console 10 it is necessary that the player 26*d* now fund the established account. Funding may occur in various fashions but several features are paramount. The funding must be secure and must be allocated to the correct account. Second the movement of funds into and out of the account should be tracked to not only support the player loyalty point accrual but for sound accounting, "receipting", record keeping to avoid disputes and tax purposes. In relation to debiting and crediting the funded account for wagers and wins, these events must be accounted for and metered separately for each player to avoid disputes and support tax and regulatory authorities.

Figure 12A:
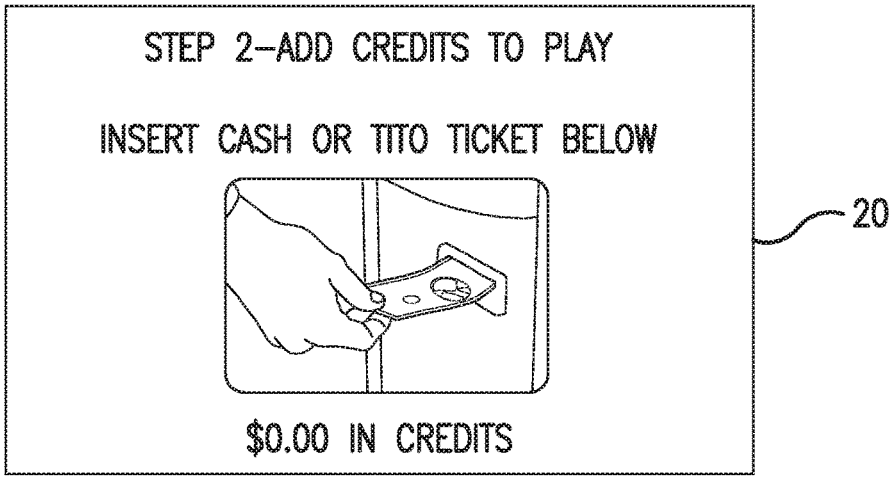
FIGS. 12A-12C illustrate adding credits at a kiosk for wagering and messaging to prompt play.
Figure 12B:
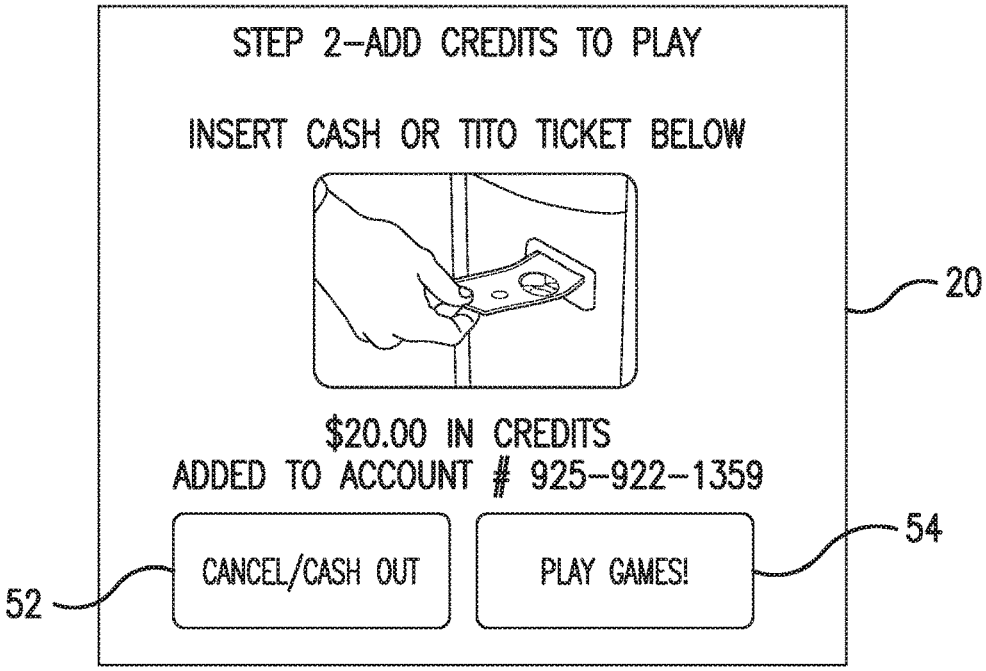
Figure 12C:
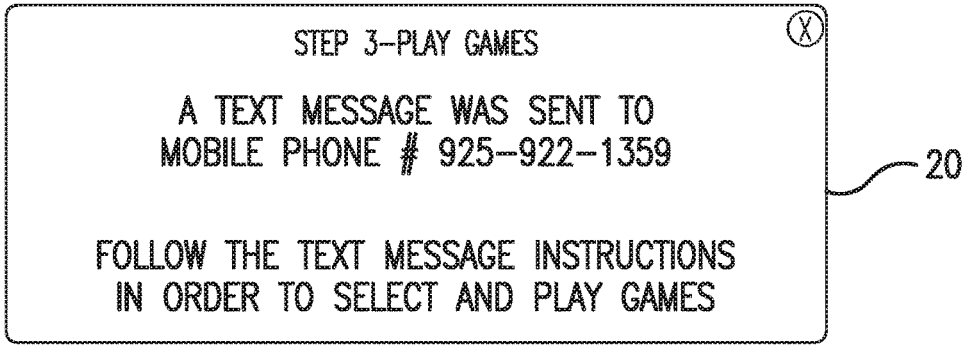

To accrue funds into the player 26*d* account for wagering, the now tethered player may, using their account number established at tethering, insert cash, script or other physical instrument representing value at a kiosk or at the tethering unit 18 itself to at 48 fund their account. For example, upon the completion of tethering the tethering unit 18 may display as suggested in FIG. 12A a display inviting the player to fund their account. The player 26*d* inserts, for example, cash into a cash validator 50 (FIG. 9) at the tethering unit 18. As shown in FIG. 12 B the tethering unit video display 20 displays a confirmation that the value has been added to the player 26*d* account having a name based upon the player 26*d* mobile device 26*d* telephone number. A reverse button 52 may be provided at the GUI for the tethering device display 20 to cancel the transaction or cash out. To play the player 26*d* now touches a play button 54 which results in the processor 24 controlling the tethering device video display 20 to display a message as suggested in FIG. 12C instructing the player that a message has been sent to the player device 26*d*. In response the player device 26*d* may display the information as set forth at FIG. 13A-B which will be discussed below. Touching the play button 54 configures the system at 55 (FIG. 9) for the play of games.

Figure 11:
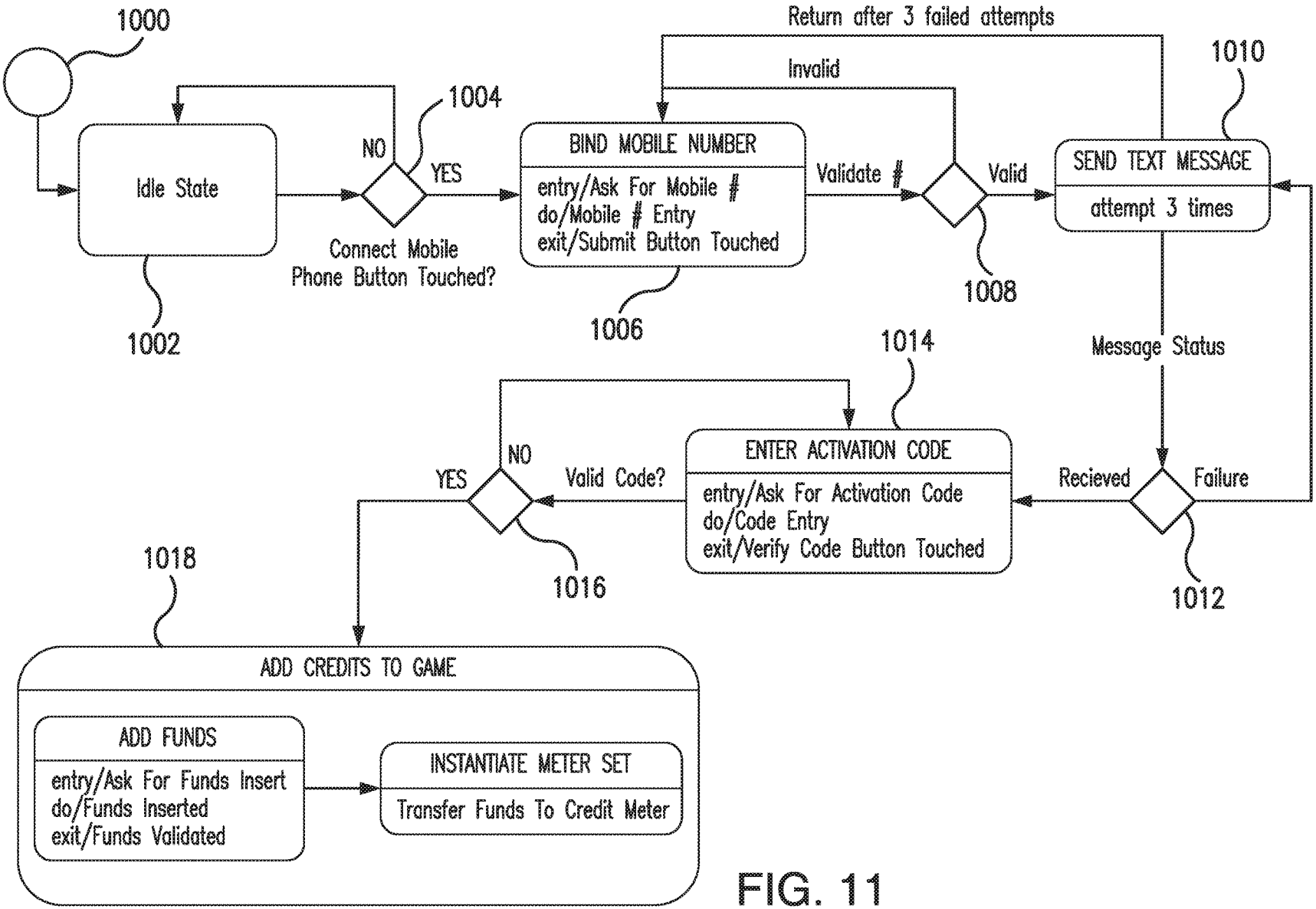
FIG. 11 is a logic diagram showing the tethering of a player's device, accepting of funds and crediting a credit meter.

FIG. 11 provides somewhat of an operational recap of the tethering and funding system and method described above. At 1000 the player 26*d* approaches the tethering unit 18 which at 1002 may be in an idle state. If at 1004 a "connect", i.e. tether, button is selected by the player at the tethering unit display 20 at 1006 the tethering process in initiated by the player 26*d* and at 1008 the player's mobile number is confirmed and at 1010 the message with the account code is sent to the player's mobile device 22*d*. As shown if the mobile number is invalid or if the player 26*d* failed on three attempts to enter a correct number the process returns to the invitation to tether display such as depicted at FIG. 10A. The sending of the tethering activation code may result in either the message being received at the player mobile device 22*d* or the message has failed at 1012. If the transmission has failed the process returns to 1010 to resend the message. If the message is received at 1014 player 26*d* enters the transmitted activation code at the tethering unit 18. If at 1016 the code is valid the processor 24 establishes the player's account and at 1018 controls the tethering unit to display the instruction to guide the player 26*d* through the steps of funding the account and establishing the player's assigned play meter(s). If at 1016 the entered code is invalid the player 26*d* is invited at 1014 to re-enter the code.

It should be noted that either before or at the time of tethering of the player's mobile device 22*d* for play at the console 10, a software application may be downloaded or made accessible to control the player's mobile device 22 video display to display various information, user interface(s) to enable the player to interact with the console 10 and the processor 24 for the funding, metering, play and other events and controls for the player to play games or events at the console 10. Further the tethering enables the player mobile device 26*d* to wirelessly communicate with the console processor 24 either through and automatic or required login to the environment WiFi network, creating an open broadband call channel (this is not preferred due to roaming and usage charges) or other network communication. The communication should be relatively fast inasmuch as the player device 22*d* and processor 24 may be exchanging data and inputs such that a fast response is required.

Figure 13A:
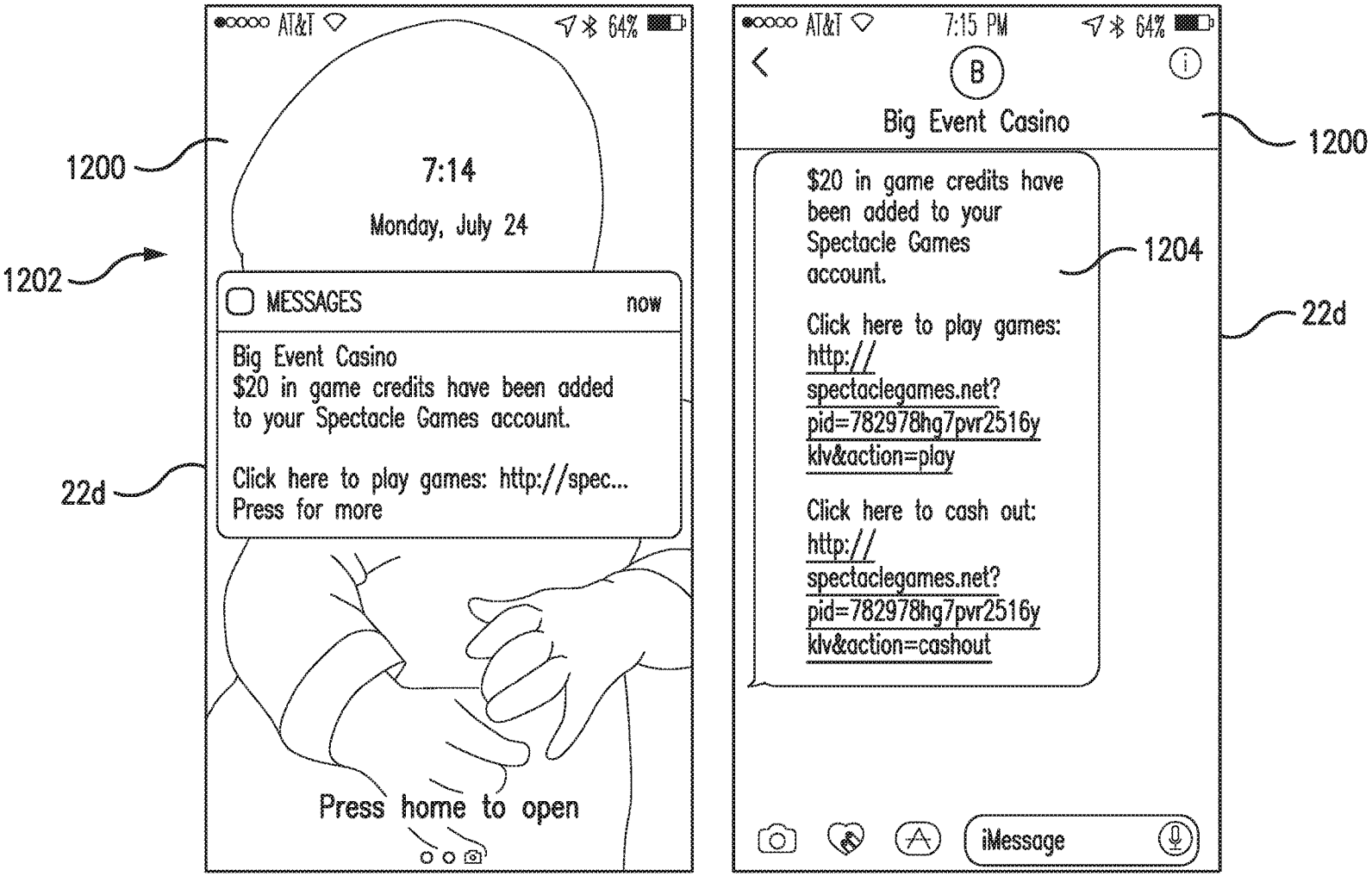
FIGS. 13A-13C show a player's mobile device video display and user interface to support play of one or more games of the system and method of the present invention.
Figure 13B:
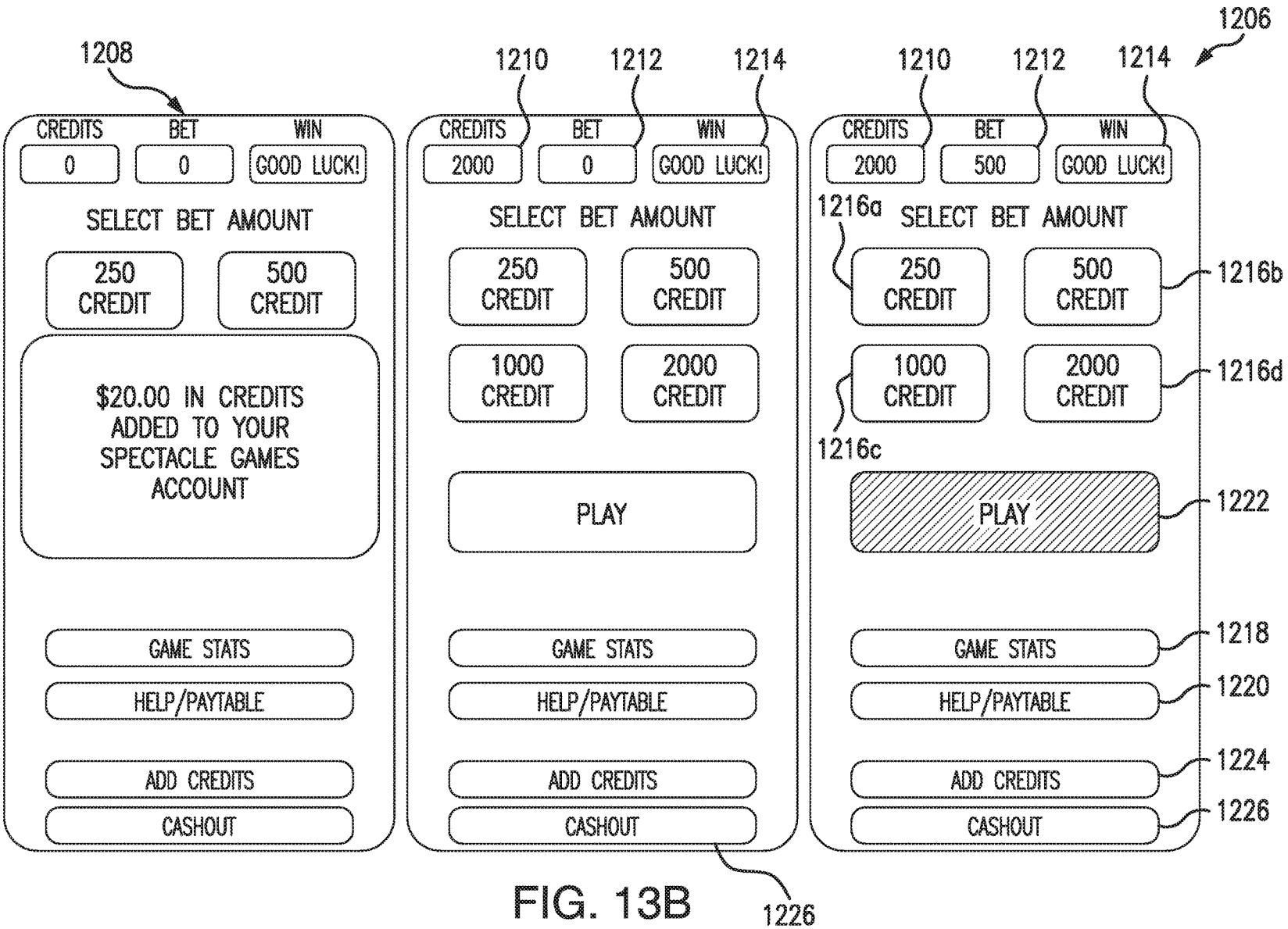
Figure 13C:
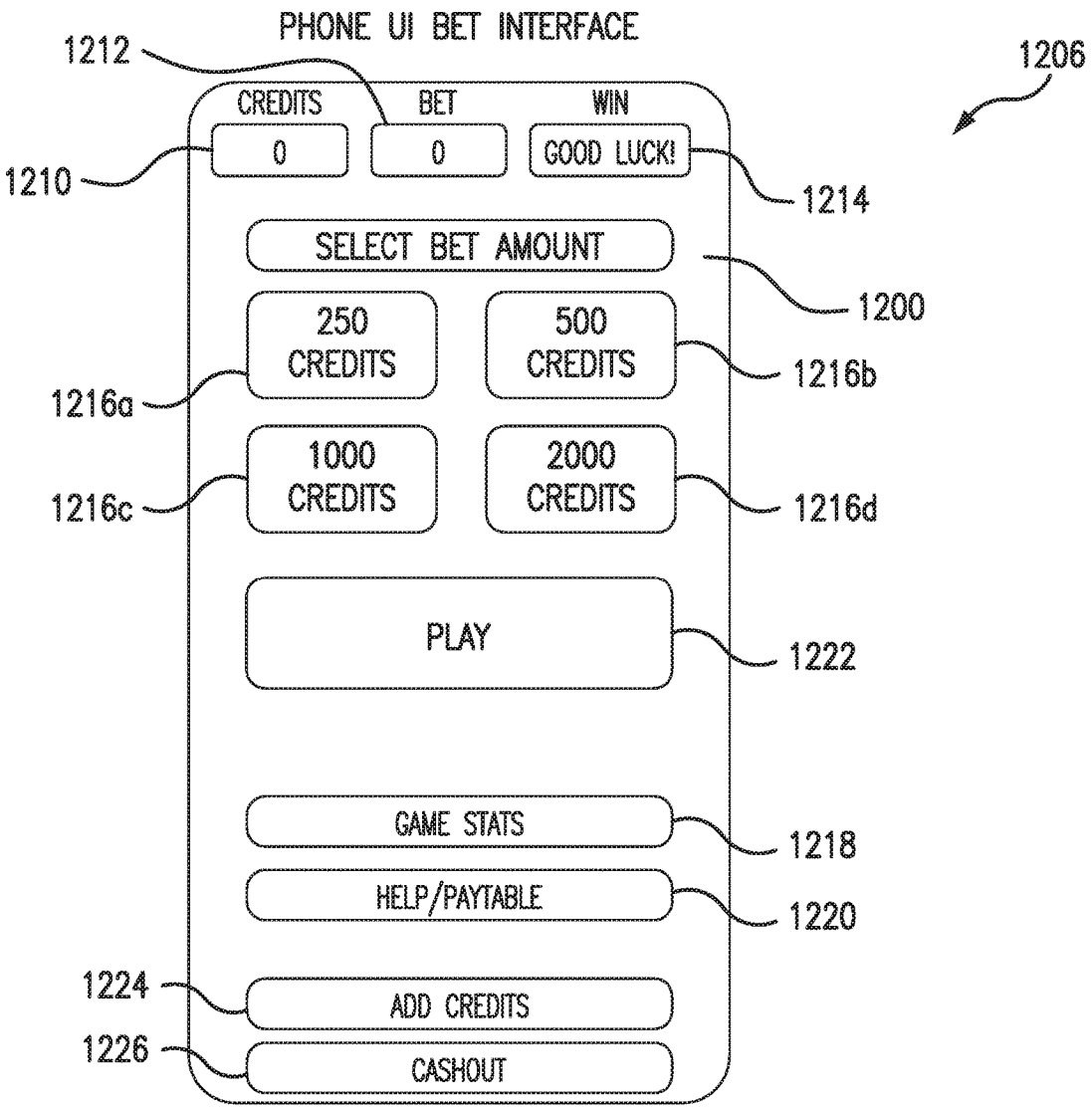

FIGS. 13A-C show examples of the players' user interface displays populated to their mobile device by one or more or the processor 24 or the resident application at the player's mobile device 22*d*. A player's mobile device video display 1200 at 1202, upon tethering and funding as described above, may display a greeting announcing the console game or event, confirming the funding to the player's account and providing instructions for the play of the game/event. When the player follows the instructions, e.g. pressing the home butting on their device 22*d*, a selection GUI 1204 may be displayed again confirming funds in the player's account and providing a play or a cash out option in the form of links to resources such as the display of a play and metering GUI, i.e. play GUI 1206. During the transition from the selection GUI 1204 and the play GUI 1206 a segue display 1208 may again confirm the funding in the player's account. The play GUI 1206 may have numerous displays and "buttons" to facilitate play. For example the play GUI 1206 may show a credit meter 1210, bet meter 1212 and win meter 1214. These meters 1210, 1212 and 1214 meter the player's credit balance, how much they have bet for a particular proposition and how many credits have been paid to the player for a winning outcome on the wagered upon proposition. The play GUI 1206 may also display interactive touch buttons for the player to select the amount to wager on a proposition. For example wager buttons 1216*a-d* enable the player to select to wager 250, 500, 1000 or 2000 credits, respectively, on a proposition. There may be more or fewer configured buttons and the number and their configuration may change depending upon the game being played. For example, is a slot game is being player buttons may be presented to enable the player to select how many pay lines to wager upon and how much to wager per pay line. Buttons may be provided to enable the player to select to wager in a different denomination. That is a player may choose to change the value of a credit from 1¢ to 10¢. Additional touch screen buttons such as a game stats button 1218 to access a resource to display, for example game/event outcome history (such as for Baccarat showing Bank hand wins, Player hand wins and Ties), help/pay table button 1220 to access a resource to display game help information and the game pay table/odds for game/event outcomes. A play button 1222 is also provided to enable the player to prompt play of a game or event. When the player's mobile device 22 becomes tethered for play as described above, the processor 24 and/or the resident application on the mobile device 22 are configured to enable at least WiFi communication between the processor 24 and the mobile device 22. This communication link enables data to be bi-directionally transmitted to, for example, provide data at the mobile device display 1200 for display of the various meters, information and instructions and to provide input from the player such as wager information, proposition information and a play prompt instruction. In an embodiment where the game played by the player is a virtual slot machine game of the type having virtual spinning reels to display a winning or losing outcome for a game play, the player would input, for example, their selection of the pay lines selected for play and the wager per pay line. The player may the touch the play button 1222 which causes a signal to be transmitted through, for example, a local WiFi network to start game play. In an embodiment the player may make a gesture with their device 22 after touching the play button 1222 to prompt play such as a downward swipe. In another game such as a selection game the player may make a wager and the game may present value images at the console video display such as virtual fish in a virtual aquarium and the player gestures with their device 22 to move a cursor or lure attributed to the player to catch the fish whereupon an award of credits is earned. The event may be a timed event.

The GUI 1206 also displays an add credits button 1224 which, if touched, commands the processor 24 to control, for example, the tethering unit video display 20 to display information and instructions for the player to deposit value to accrue additional credits into their account in the manner described above.

To enable the player to initiate a cash out sequence a cash out button 1226 button may be provided. In an embodiment the player would approach the tethering unit 18 (or a separate kiosk) and depress the cash out button 1226 on the GUI 1206. A signal is sent to the processor 24 to close the player's account and send data to a ticket or voucher printer at the tethering unit 18 to print a voucher or ticket representing the value and to send a message to through the network 42 to an appropriate server accounts for the ticket, logs the transaction and stores the information such that at a cash out kiosk or counter the player may redeem the ticket for cash script/coin. In another embodiment upon touching the cash out button 1226 the processor 24 and resident software application cooperate to account for and log the transaction and cause a message to be generated the mobile device 22 confirming the cash out event, the value cashed out and to present a machine readable code or image at the mobile device display 1206. This message and code may be saved by the player as a receipt and for recalling at a kiosk or at the tethering unit 18 for machine reading of the code and dispensing of cash script/coin to the player. In yet a further embodiment touching the cash out button 1226 may cause the funds to be credited to the player's electronic account, e.g. an electronic wallet or "eWallet", established at the gaming venue.

Figure 14A:
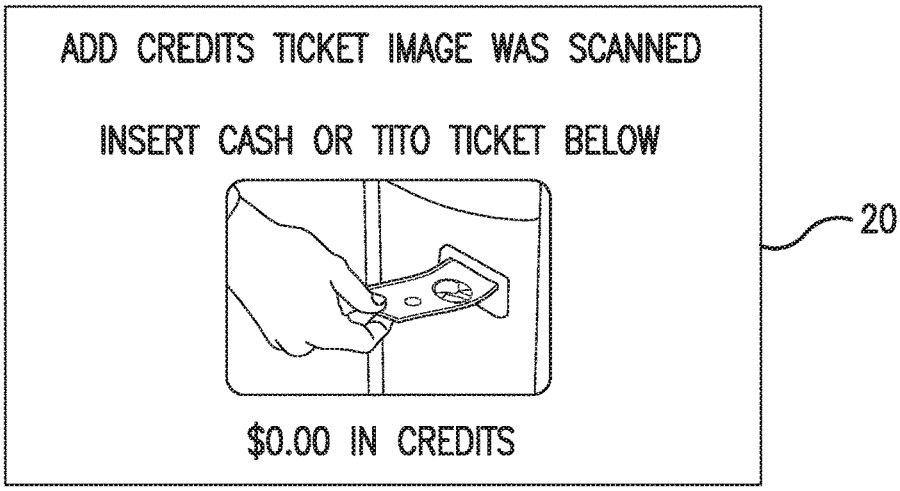
FIGS. 14A and 14B illustrate a player adding addition credits for play.
Figure 14B:
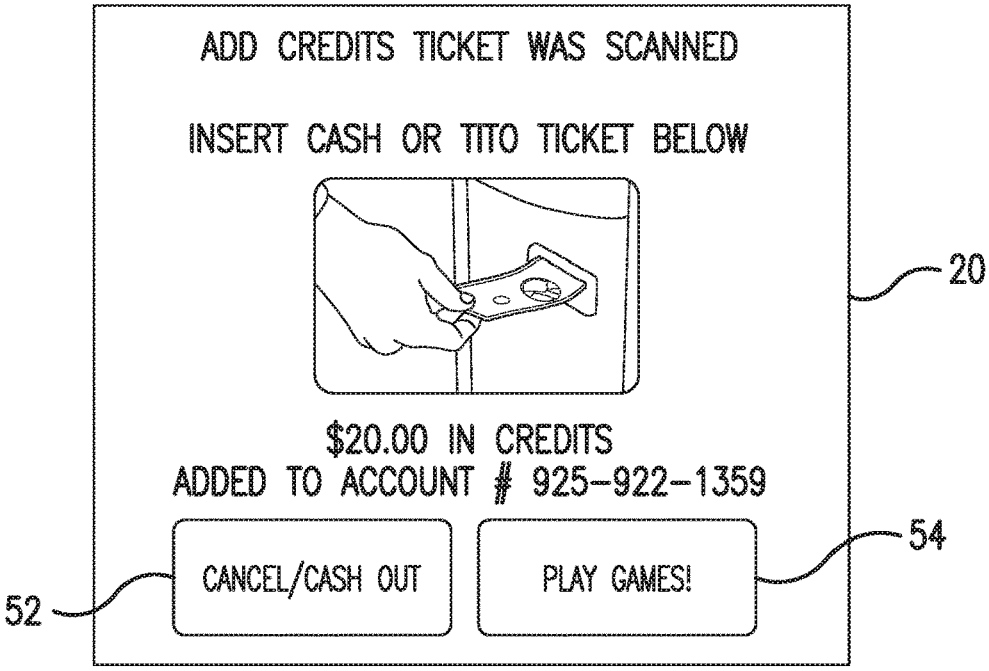

To replenish credits for wagering and for cashing out accumulated credits those features will be described with reference to FIGS. 14A, B and 15. To replenish credits for wagering he player with an established account goes to the tethering unit 18 (or a separate kiosk) and awakes the tethering unit display 20 from an idle state such as touching the tethering unit display 20. The player is then prompted as at FIG. 14A to enter their account number via the touch enabled keypad 38. Once the account is accessed the player may input a cash or a ticket/voucher into a reader 50 at the tethering unit 18 which funds are credited to the player's account. FIG. 14B shows the display of a verification of receipt and allocation and the player may then touch the play button 54 to resume play. In an alternative embodiment the player may go to the tethering unit 18 or a kiosk and inserts cash or a ticket/voucher into a reader 50. Upon receipt and verification the tethering unit display 20 would display a user interface including the keypad 38 prompting the player to input their account number. Upon receipt and verification of the account number the funds are credited and the tethering unit display 20 is controlled to display a verification of receipt and allocation of the funds.

Figure 15:
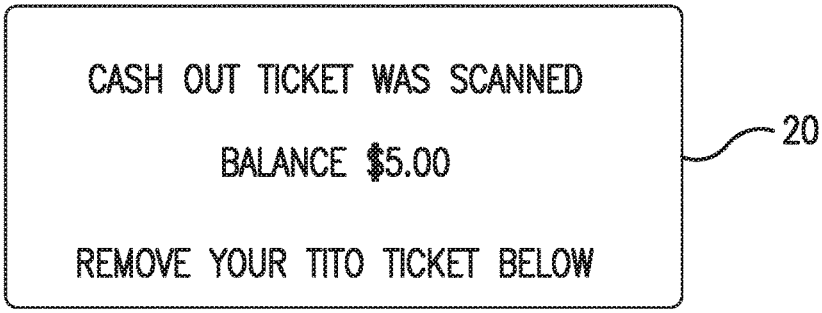
FIG. 15 illustrates a display at a tethering unit or kiosk for cashing out credits.

To cash out credits from the system, the player goes to the tethering unit 18 or a kiosk, awakens the tethering unit display 20 from an idle state and selects a displayed touch screen cash out button 52. The player is invited to enter their account number with the keypad 38. In response the system may print a voucher representing the cash value or transfer the value to the player's eWallet. As shown in FIG. 15 the tethering unit display 20 or kiosk display would display a confirmation of the value cashed out with instruction to the player to remove the printed ticket.

As can be appreciated from the above one or more players may be able to tether their devices 26*a-d* to the console 10 for pay of games, such as those described below. A feature of the present invention is that the console 10 and related systems and methods are adapted to permit the console 10 to be "dropped" into a gaming environment as a standalone unit appearing to the gaming environment network, perhaps servicing hundreds or thousands of gaming machines, as just another gaming machine. This modularization of the console 10 platform presents challenges such as how to track, account, award and record individual transactions and activities for purposes of individual player tracking, individual system provided awards and functionalities and reporting where, from a functional standpoint, the players' activities are taking place often simultaneously through the console 10. Accordingly the transaction data at the console 10 must be packaged for transmission to the back end network system.

Figure 8A:
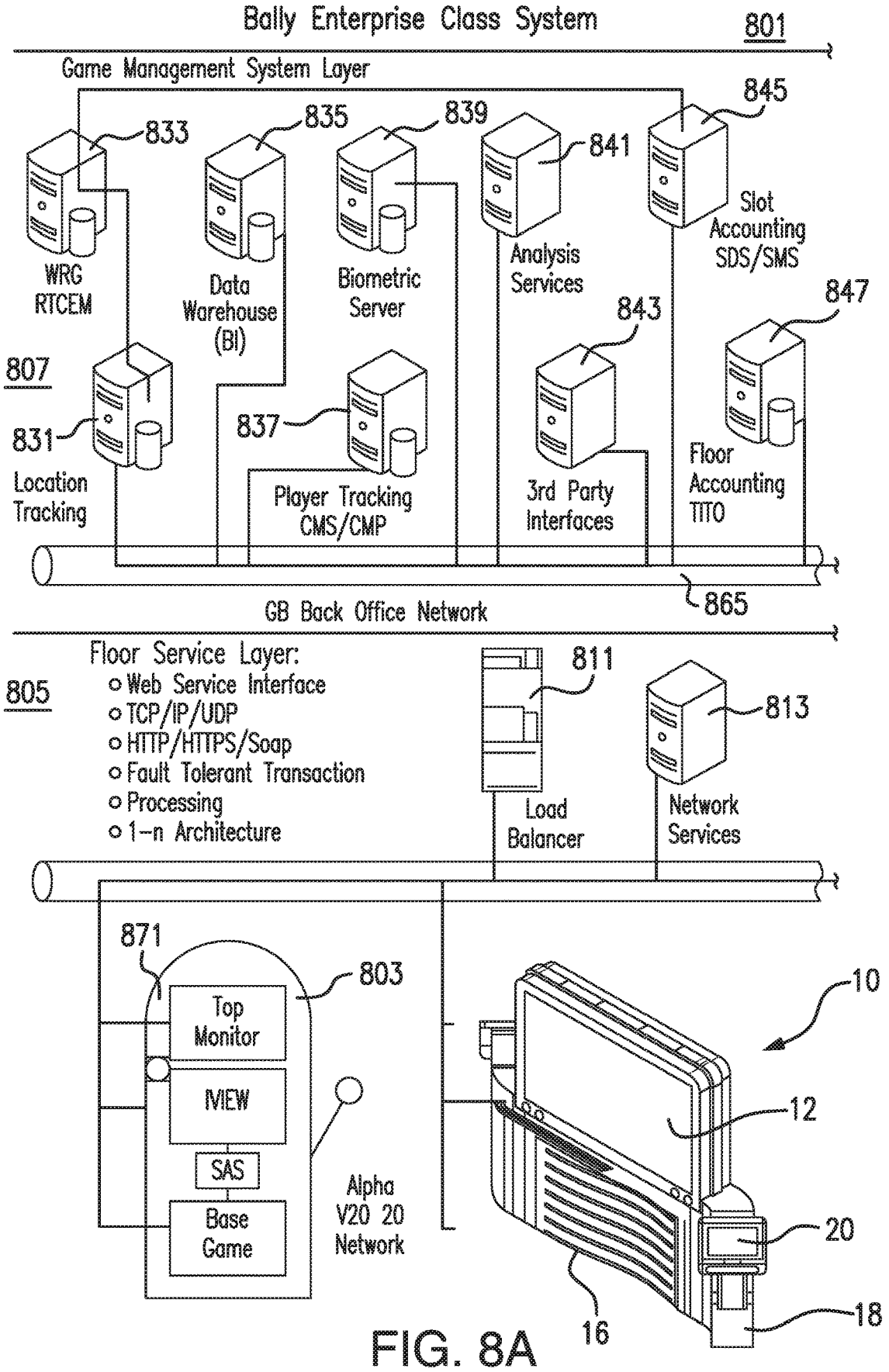
FIGS. 8A and 8B illustrate a casino enterprise network system incorporating one or more gaming terminals and the gaming console.
Figure 8B:
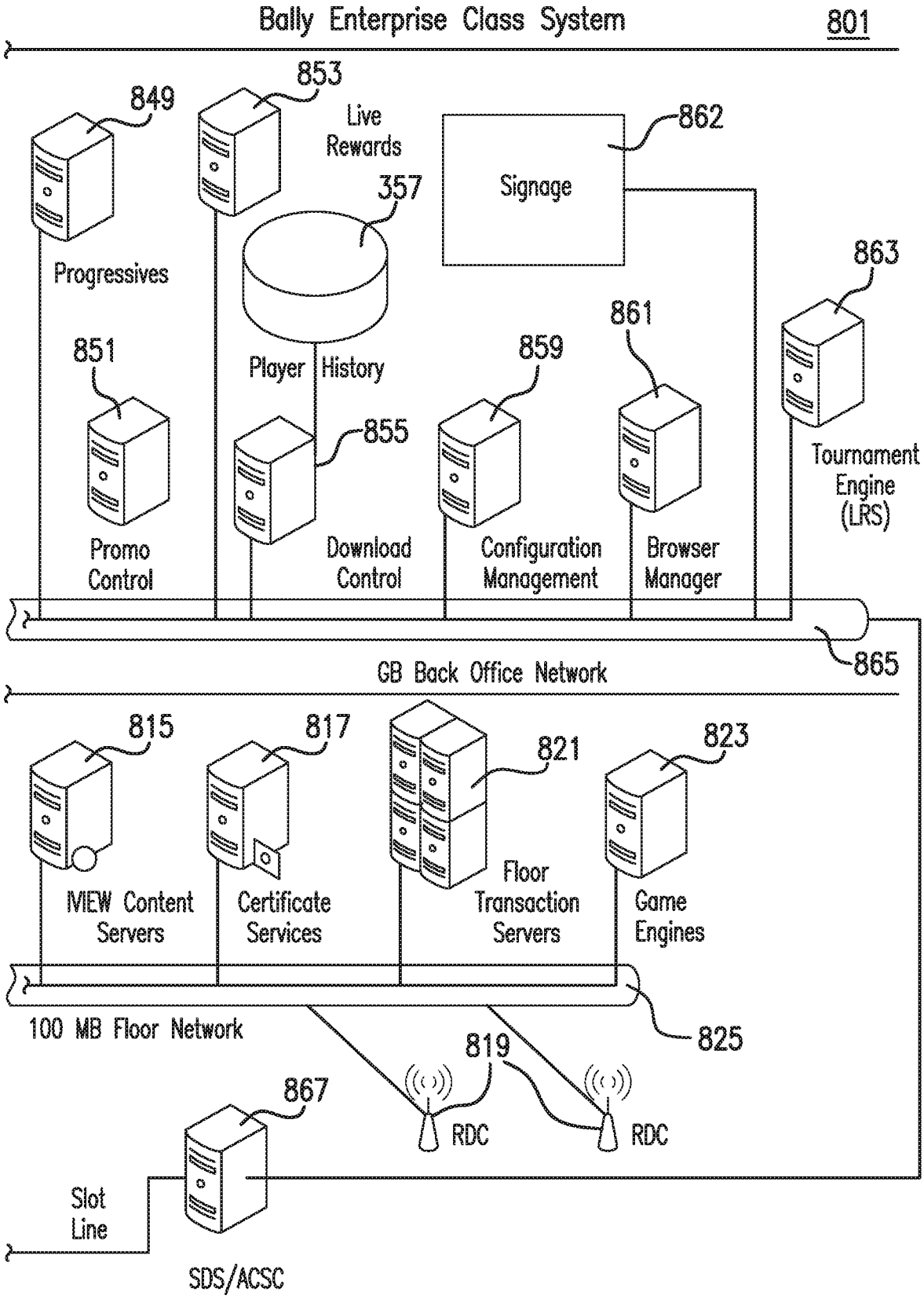

Referring to FIGS. 8A and 8B, an example of a known and typical "backend" gaming enterprise system 801 for attending to gaming devices is shown in accordance with one or more embodiments which now includes the console 10. Gaming enterprise system 801 may include one casino or multiple locations (herein referred to collectively as a casino enterprise) and generally includes a network of gaming devices of the type known in the prior art (and often referred to as slot machines), the console 10, floor management system (SMS) 805 and casino management system (CMS) 807. SMS 805 may include load balancer 811, network services server 813, player tracking module 28, iView (PTM 28), content servers 815, certificate services server 817, floor radio dispatch receiver/transmitters (RDC) 819, floor transaction servers 821 and game engines 823 (where the gaming terminals 803 operate server based, server supported or downloadable games), each of which may connect over network bus 825 to gaming terminals 803 and console 10. CMS 807 may include location tracking server 831, WRG RTCEM (William Ryan Group Real Time Customer Experience Management from William Ryan Group, Inc. of Sea Girt, N.J.) server 833, data warehouse server 835, player tracking server 837, biometric server 839, analysis services server 841, third party interface server 843, slot accounting server 845, floor accounting server 847, progressives server 849, promo control server 851, bonus game (such as Bally Live Rewards) server 853, download control server 855, player history database 857, configuration management server 859, browser manager 861, tournament engine server 863 connecting through bus 865 to server host 867 and gaming terminals 803 and the console 10. The various servers and gaming devices 803 and console 10 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming devices 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Like the gaming devices 803 the console 10 includes various peripheral components that may be connected with USB, serial, parallel, RS-485 or Ethernet devices/architectures to the system components within the console 10. For example the console 10 may be provided with a GMU (game monitoring unit) has a connection to the one or more processors 24 and/or intermediate processors through a serial SAS connection. The system components in the console 10 may be connected to the servers using HTTPs or G2S protocols over Ethernet. Using CMS 807 and/or SMS 805 servers and devices, firmware, media, operating systems, and configurations may be downloaded to the system components of respective gaming devices 803 and console 10 for upgrading or managing floor content and offerings in accordance with operator selections or automatically depending upon CMS 807 and SMS 805 master programming.

The gaming system 801, among other functionalities such as slot accounting (i.e. monitoring the amount wagered ("drop"), awards paid) and other casino services, includes the player tracking CMS/CMP server 837 and/or data warehouse 835 storing player account data. This data includes personal data for players enrolled in the casino players club sometimes referred to as a loyalty club. An example of the personal data is the player's name, address, SSN, birth date, spouse's name and perhaps personal preferences such as types of games, preferences regarding promotions, player rating level, available player comp points (points accumulated based upon commercial "spend" activity with the enterprise including gaming and which may be redeemed or converted into cash or merchandise) and the like. As is known in the industry and according to the prior art, at enrollment the player is assigned a created account in the player tracking CMS/CMP server 837 and is issued a player tracking card having a machine readable magnetic stripe.

When a player plays a gaming device according to the prior art, he/she inserts their player tracking card into the card reader at the gaming device which communicates data to the CMS/CMP server 837 to accumulate loyalty ("comp") points based upon the wagers/wins of the player. For example, a player may accumulate one comp point for each $5 wagered. Comp points may also be awarded as part of a promotion and for other commercial activity such as the purchase of goods or services.

The system 801 may also include electronic transfer of funds functionality. For example, a player having accumulated $100 at a gaming device or console 10 may decide to "cash out" to play another gaming device. The player, for example using the PTM 28 to initiate communication with the system 801 for example server 837 to upload the value from the gaming device into an electronic account associated with the player's account. The player may choose to upload all or a portion of the funds the player's established electronic account. The system would prompt the player to enter their PIN (or obtain biometrical confirmation as to the player's identity) and upload the chosen amount to their account. When the player moves to another gaming device he/she inserts their player loyalty card into the card reader to access their account. A prompt provides for the player to request funds from their account. Entering their PIN (or biometric identifier) and/or account number the player can input the desired amount which is downloaded to their gaming device or console 10 for play.

To facilitate communication between gaming devices of the prior art, the gaming devices are typically fitted with a system interface generally referred to as a SMIB (slot machine interface board). The SMIB receives information from the gaming device operations such as meters (credit, cash-in, bet, win, cash out) security and other reporting and provides the same to the system 801. Standard communication protocols have been developed to facilitate the transmission of the information to enable new gaming devices of different manufacturers to be "dropped" into the gaming floor and communicate with the system 810 which may be provided from a variety of vendors. Inasmuch as casino floor real estate is precious networks, SMIBs and other interfaces are provided to make installations and set-up of gaming devices on the floor as quick and effortless as possible. That is, to install a new gaming device the network 801 does not require extensive reconfiguration.

It is an object of the present invention to provide the system and method, represented by the console 10, which provides for play, even simultaneous or group play, by which the console 10 may be introduced as a module into a gaming floor as if it were a singular gaming device, i.e. a slot machine. Accordingly the console 10 processors 24 may include a SMIB and GMU to provide communications of the type received by the network 801 utilities as if it were a gaming device. It should be understood that since there may be several players the messaging from the console 10 to the system 801 must support segregation of individual player data for the system as if each player was playing a single gaming device. This feature is described below.

Figure 16:
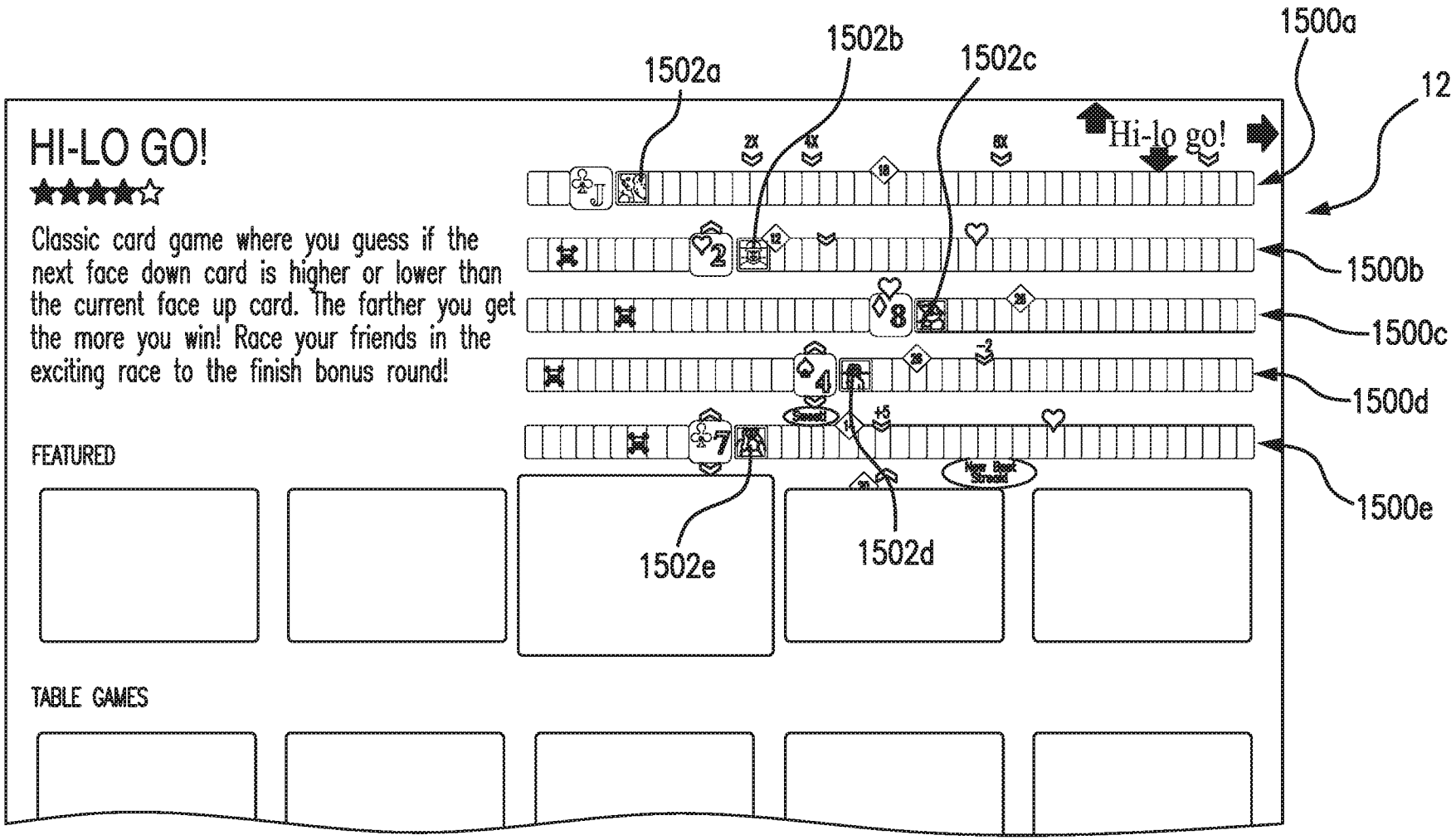
FIG. 16 is an example of a game for play on the console.

FIG. 16 shows a display for a card selection game which may be played at the console 10 by multiple, tethered players. In this game a first, randomly selected, playing card is displayed and the players wager upon whether the next randomly revealed card will be higher or lower than the first card. In an embodiment each player plays from their own face down deck 1500*a-e* and for each player an icon 1502*a-e* is displayed at the console video display 12 showing the player's guess. For example for the player of card set 1500*a* the first randomly selected card is a J♣ and the player has wagered upon the proposition that the next card will be lower than the J♣. For each correct prediction the player is issued an award. The value of the award may be based upon the odds associated with the prediction.

The system, as shown in FIGS. 7 and 13B various meters are associated with the play of games at the console 10. As players tether their mobile devices 22*a-d* to the console 10 for play, the one or more processors 24 configure for separate player accounts and metering therefor. Each player may have various meters 30*a-d* (FIG. 7) displayed at the console video display 12 as well as at their individual mobile device 22 such as at 1210, 1212 and 1214. The display of the various individual meters 30*a-d* at the console video display 12 enables other player to compare performances.

Inasmuch as the console 10 communicates data such as data related to game performance (wagers, wins, jackpots, plays) and player loyalty data it is necessary that the console 10 one or more processors 24 be configured to provide for segregation of such data for reporting to, or by, the system 801. That is, since each game, which may be played simultaneously with other games, should be accounted for separately so that the operator can decide to discard non-performing/unpopular games the one or more processors 24 must package or arrange for serial/parallel reporting so performance data is correctly allocated for each game. Recall that to the system 801 the console appears as a gaming device which does not encounter simultaneous play by multiple players of perhaps different or duplicate versions of games at a single source—the console 10.

Figure 17:
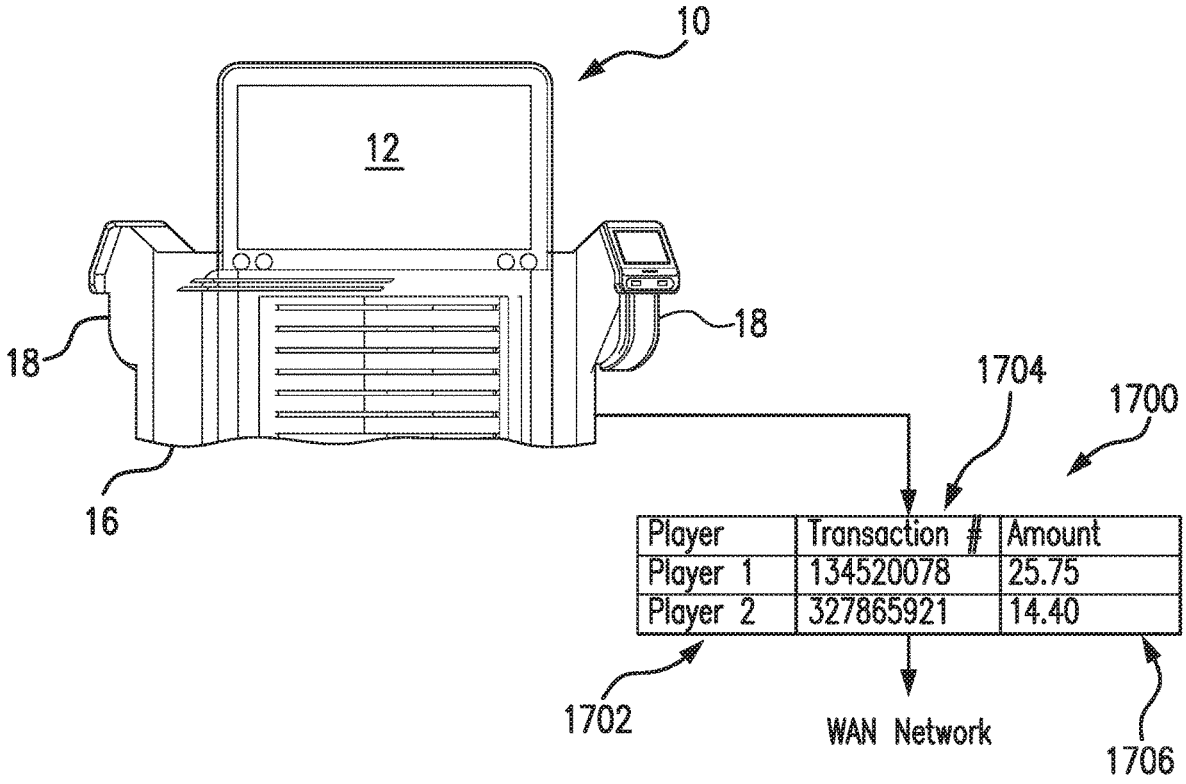
FIG. 17 illustrates the packaging of transaction receipts for reporting to the enterprise network systems.

FIG. 17 illustrates an example of the console 10 one or more processors 42 packaging player receipt data for passing up to the system for further processing. This exemplary data may be for purposes of allocating player loyalty points to each player's individual account. It may also be for accounting for money-in, credits awarded, win accounting and the like. It should be understood that the illustrated example is simplified since the nature and amount of data can vary based upon the needs of the system 801. In the embodiment shown, to provide a single message report to the system 801 such that to the system the console 10 appears as a single gaming device although it is reporting data from various disparate sources, the one or more processors 24 may be configured to package the data in a table 1700 assigning rows to each different participating player. The table 1700 includes player identifying data 1702, a transaction number 1704 and transaction data 1706, e.g. amount. It should be understood that depending upon the destination different tables may be configured such as to report player wagers for crediting player loyalty points to the individual payer accounts. In an alternative embodiment the console 10 one or more processors 24 may be periodically polled for, or the data ddddddmay "push", message data strings perhaps arranged based upon first-to-last player tethered and perhaps using game identifying nomenclature. For example every ten seconds the one or more processors (including the SMIB) may be polled from the system 801 to report player tracking data. The one or more processors 24, having established an account for each tethered player including their player loyalty account access information, would pass a message providing data segregating or otherwise identifying the data allocated to each player for processing and attribution to correct player's account. The same approach may be applied to game performance data. Accordingly the console 10 appears to the system 801 as a gaming device for reporting and accounting purposes. This feature contribute to the ease and simplicity of installation.

In an embodiment the system and method may provide periodic bonuses and/or community games for the tethered players. For example, in a base game or bonus game players may use gestures with their mobile devices 22 to toss virtual coins as wagers into the ocean world displayed at the console video display 12. If a virtual fish randomly eats his coin then the player is issued an award at the location on the console video display 12 where the fish ate the coin as suggested in FIG. 5. Each coin may have a different color to denote the different players. The game can continue indefinitely never ends since multiple players are playing on the same game at once.

Other games which can accommodate multiple players are baccarat, craps, Sic Bo and some forms of Blackjack or the like.

In an embodiment a system provided bonus or game may be provided to a player who has had their player loyalty card read at the card reader 48. As an example, periodically or based upon the player achieving a certain play level, a bonus game may be provided to the player's mobile device 22. The bonus game may be providing the player with several Bingo cards displayed at their mobile device 22 for play which, if the player has a winning Bingo card, awards the player value or additional comp points.

In a further embodiment the player's mobile device 22 may also display a system interface such as at a portion of the player's mobile device 22 display 1200. The player can, through that interface, access their loyalty account to, for example, download credits for free play into their account, view the status of their account or access other goods and services.

In a further embodiment the player may be able to tether their mobile device 22 for play of the console 10 using a sonic "handshake" with a tethering unit 18. According to this embodiment the player would awaking the tethering unit from an idle state such as by touching the tethering unit display 20. The display 20 would offer for the player to tether using a close proximity sonic binding feature. If accepted the player would access their device 22 application and be instructed to position their device 22 proximate the display 20 or an adjacent panel.

In another embodiment the player may anonymously tether their mobile device 22 for play of a game or event at the console 10.

As stated above the console 10 provide for the play of games such as slot games or other games but may also provide for sports or other event wagering. In an embodiment inter-game events such as whether the kicker will make or miss a field goal in a game viewed at the console 10 or whether the batter will hit the ball out of the infield can be provided.

We claim:

1. A system for supporting localized remote gaming by one or more players each using a mobile player device having a video interface and including a game console having a large console display to display a plurality of gaming events for a plurality of players and one or more console processors for one or more of (a) controlling the large console display to display gaming event content including outcomes for each event or (b) receiving from a remote source event content for display of event outcomes at the large console display for each event, the system comprising:

a wireless communication network to provide for wireless communication between the one or more console processors and the mobile player devices;

a tethering unit, associated with the game console, having a tethering unit display, the tethering unit controlled by the one or more console processors to display content for players to functionally tether their devices to the console by one or more of (a) scanning or entering a code or (b) entering the mobile device cellular number;

the one or more console processors configured to, upon each player tethering their mobile player device via the tethering unit configuring a unique player account associated with each tethered mobile player device including credit, wager and win meter data as well as data representing transaction receipts between the player and their account;

means for each player of a tethered mobile player device to apply credits for wagering to their account; and the one or more processors configured to receive wireless instructions from the video interface of a tethered mobile player device to register a wager on a selected game event, the one or more processors configured to control the large console display and video interface to display the play and outcome for one or more game events and for each player credit meter, win meter and wager meter data.

2. The system of claim 1 wherein the mobile player device is a cellular telephone having a unique telephone number the system comprising the tethering unit including a user interface for a player to enter the cellular telephone number to functionally tether their mobile player device to the game console.

3. The system of claim 1 comprising the one or more processors configured to control the tethering unit display to display a code readable by a player device to tether the mobile player device to the game console.

4. The system of claim 1 comprising the one or more processors configured to control the large console display to display for each tethered mobile player device one or more of credit, wager and win meter data in a display window allocated to the player at the console display.

5. The system of claim 4 comprising the one or more processors configured to control the large console display to display for each tethered mobile player device one or more of credit, wager and win meter data in a display window allocated to the player at the large console display wherein the location of the window at the display is related to the order in which players tethered their mobile player devices to the game console.

6. The system of claim 1 comprising the one or more console processors configured to associate an account code with the player account associated with each tethered mobile player device for allocating funds to the player account.

7. The system of claim 6 comprising one or more of the tethering unit or a kiosk configured to receive the account code and a physical value instrument including currency, a voucher or a machine readable card and to associate the value represented by the instrument with the player account.

8. The system of claim 1 comprising the one or more processors configured to provide over the wireless communication network to one or more mobile player devices a bonus game for play.

9. The system of claim 1 comprising the tethering unit configured to receive information to allocate data related to one or more of a player's wager, play and outcome to a corresponding player loyalty account.

10. In a casino environment including gaming machines and a wide area network (WAN) to support communications between each gaming machine and back-end servers supporting accounting and player tracking functions, a system for providing a multi-player gaming console to support wireless gaming by one or more players each using a mobile player device having a video interface, the game console having a large console video display to display one or more gaming events to the one or more players, the system comprising:

a game console processing module configured to include, (1) a data structure storing, a. software applications to support each of a plurality of wagering games and video displays therefor, b. software to support wired and wireless communications between each mobile player device and the game console processing module, c. player account identification data associated with each player who has tethered their mobile player device to the game console for play, and d. transaction data including authorization numbers, gaming win and wager meter data, transaction receipts for funds in and funds out, (2) a multi-channel wireless transceiver;

(3) a tethering unit including a player interface;

(4) a WAN communication interface;

(5) a processor configured to, a. receive from a player at the tethering unit player interface input of a player account number, b. generate and wirelessly send via the transceiver to the mobile player device for display at the video interface a code and receive from the player at the tethering unit player interface input corresponding to the sent code to uniquely associate the player device to an account at the data structure and tether the player device to the game console for gaming, c. receive at the tethering unit player interface data representing the tender of value for gaming and input to associate the value with the player's account, and d. transmit to the player mobile device via the transceiver a message including a resource locator interface which when selected by the player causes the processor to, i. cause the player mobile device to display a game interface for the player to transmit game play related inputs to the processor, ii. control the large console video display to display the game at a video display interface of the game console, iii. account at least at the player's account for game wagers and wins, iv. display at the large console video display data to associate the player with the game displayed at the large console video display, and e. package and transmit to the back-end servers data supporting accounting and player tracking functions for each player.

* * * * *